US007413178B2

(12) United States Patent
Fujii et al.

(10) Patent No.: US 7,413,178 B2
(45) Date of Patent: Aug. 19, 2008

(54) SHEET PROCESSING APPARATUS AND CONTROL METHOD THEREFOR

(75) Inventors: Takayuki Fujii, Tokyo (JP); Norifumi Miyake, Chiba (JP); Yasuo Fukatsu, Chiba (JP); Tsuyoshi Moriyama, Ibaraki (JP); Takako Hanada, Ibaraki (JP)

(73) Assignee: Canon Kabushiki Kaisha (JP)

( * ) Notice: Subject to any disclaimer, the term of this patent is extended or adjusted under 35 U.S.C. 154(b) by 195 days.

(21) Appl. No.: 10/953,396

(22) Filed: Sep. 29, 2004

(65) Prior Publication Data

US 2005/0067748 A1 Mar. 31, 2005

(30) Foreign Application Priority Data

Sep. 30, 2003 (JP) ..... 2003-341906

(51) Int. Cl.
*B65H 37/04* (2006.01)

(52) U.S. Cl. ..... 270/58.11; 270/58.01; 270/58.08

(58) Field of Classification Search ..... 270/58.01, 270/58.08, 58.11
See application file for complete search history.

(56) References Cited

U.S. PATENT DOCUMENTS

| | | | | |
|---|---|---|---|---|
| 4,240,856 | A | 12/1980 | Craemer et al. | |
| 5,119,146 | A | 6/1992 | Nobumori et al. | |
| 5,289,251 | A | 2/1994 | Mandel et al. | |
| 5,626,336 | A | 5/1997 | Adami | |
| 5,765,824 | A | 6/1998 | Kawano et al. | |
| 5,947,470 | A | 9/1999 | Fernandez | |
| 6,145,834 | A | 11/2000 | Hirota et al. | |
| 6,199,850 | B1 | 3/2001 | Seki | 270/58.07 |
| 6,217,016 | B1 * | 4/2001 | Honmochi et al. | 270/37 |
| 6,219,503 | B1 * | 4/2001 | Miyake et al. | 399/85 |
| 6,220,592 | B1 * | 4/2001 | Watanabe et al. | 271/241 |
| 6,378,864 | B1 | 4/2002 | Iesaka | |

(Continued)

FOREIGN PATENT DOCUMENTS

JP 4-187498 A 7/1992

(Continued)

OTHER PUBLICATIONS

The Specification and Drawings of related U.S. Appl. No. 11/735,856, filed Apr. 16, 2007 entitled Sheet Processing Apparatus and Sheet Processing Method.

*Primary Examiner*—Gene O. Crawford
*Assistant Examiner*—Leslie A Nicholson, III
(74) *Attorney, Agent, or Firm*—Rossi, Kimms & McDowell LLP

(57) ABSTRACT

A sheet processing apparatus which is capable of accurately superimposing or aligning sheets discharged from an image forming apparatus during buffering even when the space intervals between the sheets are reduced. A sheet processing apparatus sequentially receives sheets discharged from an image forming apparatus and carries out post-processing on the sheets. During execution of the post-processing on the sheets, a plurality of sheets are discharged successively from the image forming apparatus and superimposed one upon another around a buffer roller. The conveying speed of the sheets is controlled such that a conveying time period over which a sheet preceding a final one of the sheets to be superimposed one upon another around the buffer roller is conveyed over a predetermined path section is shorter than a conveying time period over which the final one is conveyed over the predetermined path section.

4 Claims, 34 Drawing Sheets

U.S. PATENT DOCUMENTS

| | | | | |
|---|---|---|---|---|
| 6,427,997 | B1 | 8/2002 | Hirota et al. | |
| 6,526,254 | B2 | 2/2003 | Futagawa | |
| 6,796,559 | B2 | 9/2004 | Hirota et al. | |
| 6,959,165 | B2 * | 10/2005 | Mandel et al. | 399/391 |
| 7,111,838 | B2 | 9/2006 | Sasa et al. | |
| 7,182,333 | B2 | 2/2007 | Tamura et al. | |
| 7,240,901 | B2 | 7/2007 | Matsumoto et al. | |
| 2002/0014733 | A1 * | 2/2002 | Miyake et al. | 270/58.08 |
| 2002/0063384 | A1 | 5/2002 | Quesnel | |
| 2003/0006548 | A1 * | 1/2003 | Murata et al. | 271/256 |
| 2004/0217541 | A1 | 11/2004 | Horio | |
| 2004/0230336 | A1 | 11/2004 | Matsumoto | |
| 2005/0067748 | A1 | 3/2005 | Fujii et al. | |

FOREIGN PATENT DOCUMENTS

| | | | |
|---|---|---|---|
| JP | 7-215565 | A | 8/1995 |
| JP | 2001097631 | A | 4/2001 |
| JP | 2002-145515 | A | 5/2002 |
| JP | 2002-211829 | A | 7/2002 |

* cited by examiner

SHEET PROCESSING APPARATUS AND CONTROL METHOD THEREFOR

CROSS REFERENCE TO RELATED APPLICATION

This application claims priority from Japanese Patent Application No. 2003-341906 filed Sep. 30, 2003, which is hereby incorporated by reference herein.

BACKGROUND OF THE INVENTION

1. Field of the Invention

The present invention relates to a sheet processing apparatus that sequentially receives sheets discharged from an image forming apparatus and carries out post-processing on the sheets, and a control method therefor.

2. Description of the Related Art

Conventionally, there has been known an image forming system including an image forming apparatus, such as a copying machine or a laser beam printer, in which the image forming apparatus has connected thereto a sheet processing apparatus, such as a finisher, which is capable of performing various types of post processing needed by a user, such as bundle discharge processing and stapling processing, on sheets discharged from the image forming apparatus.

The sheet processing apparatus incorporated in the image forming system includes an intermediate tray where sheets with images formed thereon discharged one by one from the image forming apparatus are sequentially received and superimposed into a sheet bundle, and then post-processing, such as stapling processing, is performed on the sheet bundle, and a loading tray that receives each sheet bundle subjected to the post-processing, discharged from the intermediate tray.

The sheet processing apparatus carries out an aligning operation for aligning sheets whenever a sheet is discharged onto the intermediate tray. Further, when sheets for one bundle are discharged onto the intermediate tray, the sheet processing apparatus carries out not only the aligning operation but also other types of processing including stapling processing on the discharged sheet bundle, followed by carrying out a bundle discharge operation for discharging the sheet bundle onto the loading tray. Only after the discharge of the sheet bundle from the intermediate tray, the discharge of succeeding sheets onto the intermediate tray can be carried out. Therefore, sheets have to be discharged from the image forming apparatus at intervals of space corresponding to a time period needed for completing the post-processing of sheets on the intermediate tray.

To enable such discharge and post-processing of sheets, a first method has been known (e.g. in U.S. Pat. No. 6,199,850) in which the timing of forming an image on each sheet is adjusted to a time period needed for the post-processing of a sheet bundle to thereby adjust time intervals at which sheets are discharged from the image forming apparatus into the sheet processing apparatus, on a sheet-by-sheet basis. According to the first method, however, time intervals at which images are formed on sheets are increased, which results in reduced productivity of the image formation.

Further, a second method (buffering method) has been known in which the sheet processing apparatus keeps each sheet received from the image forming apparatus on standby in a conveying path leading to the intermediate tray, and sequentially superimposes succeeding sheets on the standby sheets (preceding sheets), one upon another, then discharging the stacked sheets which are on standby onto the intermediate tray at a time after the immediately preceding sheet bundle has been discharged from the intermediate tray onto the loading tray. The second method enables the image forming apparatus to form images on sheets and discharge the sheets having images formed thereon into the sheet processing apparatus at predetermined time intervals, regardless of a time period needed for post-processing. Therefore, it is possible to prevent reduction of productivity of the image formation.

However, when sheets to be kept on standby are superimposed one upon another by the above conventional buffering method, a preceding one has to be conveyed to a predetermined position and caused to wait at the position for arrival of the succeeding one. If the succeeding one arrives before the preceding one is brought into the standby position, ends of the sheets cannot be accurately aligned with each other when they are superimposed on upon the other. As a result, when a plurality of sheets, which are thus superimposed, are discharged onto the intermediate tray, sheet alignment in a conveyance direction (i.e. longitudinal alignment) becomes insufficient. Particularly when the sheet conveying speed is increased for enhancement of productivity of the image formation, not only the time intervals at which images are formed on sheets but also the space intervals between sheets being conveyed are shortened, which makes it difficult to accurately superimpose or align the sheets when they are placed on standby, i.e. during buffering (temporary storage at an intermediate location) thereof.

SUMMARY OF THE INVENTION

It is a first object of the present invention to provide a sheet processing apparatus and a control method therefor, which are capable of accurately superimposing or aligning sheets discharged from an image forming apparatus during buffering even when the space intervals between the sheets are reduced.

It is a second object of the present invention to provide a sheet processing apparatus and a control method therefor, which are capable of carrying out post-processing, such as sheet alignment and stapling processing, without necessitating adjustment of time intervals at which sheets are processed by an image forming apparatus and discharged therefrom, thereby ensuring high productivity.

To attain the above objects, in a first aspect of the present invention, there is provided a sheet processing apparatus that sequentially receives sheets discharged from an image forming apparatus and carries out post-processing on the sheets, comprising a sheet bundle stacking section that stacks sheets for one bundle, for carrying out the post-processing thereon, a sheet retaining section provided at a location upstream of the sheet bundle stacking section, for retaining a plurality of sheets discharged from the image forming apparatus, such that each preceding sheet and at least one succeeding sheet are superimposed one upon another, a sheet conveying section that receives the sheets discharged from the image forming apparatus and conveys the sheets to the sheet retaining section, and conveys the sheets superimposed one upon another by the sheet retaining section to the sheet bundle stacking section, and a conveyance control section that controls the sheet conveying section such that a conveying time period over which a sheet preceding a final one of the sheets to be superimposed one upon another by the sheet retaining section is conveyed over a predetermined path section by the sheet conveying section is shorter than a conveying time period over which the final one is conveyed over the predetermined path section.

Preferably, the conveyance control section controls the sheet conveying section such that a conveying speed at which the sheet preceding the final one is conveyed is higher than a conveying speed at which the final one is conveyed.

Preferably, the conveyance control section has a first conveying mode in which conveying time periods over which all the sheets to be superimposed one upon another by the sheet retaining section are conveyed over the predetermined path section are set to an equal conveying time period, and a second conveying mode in which the conveying time period over which the sheet preceding the final one is conveyed over the predetermined path section is shorter than the conveying time period over which the final one is conveyed over the predetermined path section, and the conveyance control section switches between the first conveying mode and the second conveying mode, depending on time intervals at which the sheets are discharged from the image forming apparatus.

More preferably, the conveyance control section controls the sheet conveying section such that in the second conveying mode, a conveying speed at which the sheet preceding the final one is conveyed is higher than a conveying speed at which the final one is conveyed.

More preferably, the conveyance control section controls the sheet conveying section such that the conveying time period in the second conveying mode over which the sheet preceding the final one is conveyed is shorter than the conveying time period in the first conveying mode.

To attain the above objects, in a second aspect of the present invention, there is provided a method of controlling a sheet processing apparatus that sequentially receives sheets discharged from an image forming apparatus and carries out post-processing on the sheets, the sheet processing apparatus including a sheet bundle stacking section that stacks sheets for one bundle, for carrying out the post-processing thereon, a sheet retaining section provided at a location upstream of the sheet bundle stacking section, for retaining a plurality of sheets discharged from the image forming apparatus, such that each preceding sheet and at least one succeeding sheet are superimposed one upon another, the method comprising a sheet conveying step of conveying the sheets discharged from the image forming apparatus to the sheet retaining section, and a conveyance control step of controlling sheet conveyance in the sheet conveying step such that a conveying time period over which a sheet preceding a final one of the sheets to be conveyed in the sheet conveying step and superimposed one upon another by the sheet retaining section is conveyed over a predetermined path section is shorter than a conveying time period over which the final sheet is conveyed over the predetermined path section.

The above and other objects, features, and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing a preferred embodiment thereof.

Figure 1:
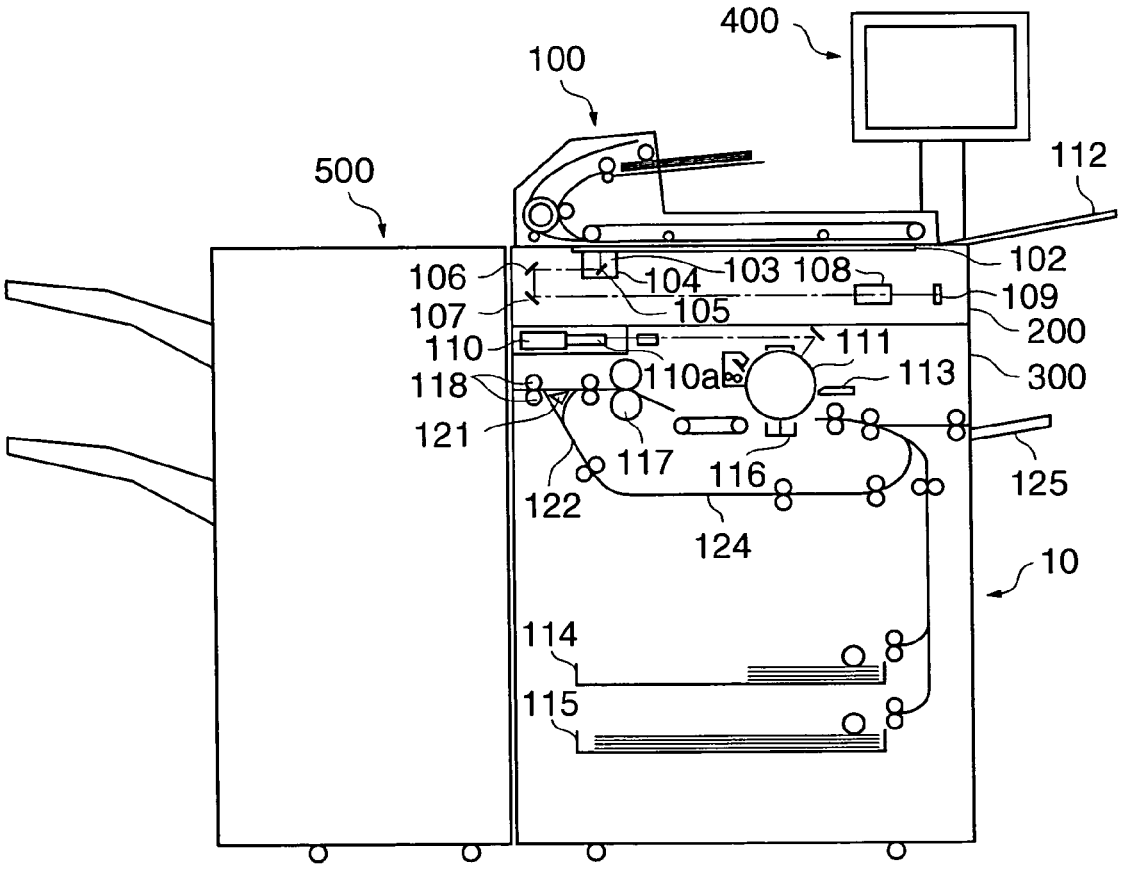
FIG. 1 is a longitudinal cross-sectional view showing the construction of an image forming apparatus equipped with a sheet processing apparatus according to an embodiment of the present invention.

FIG. 1 is a longitudinal cross-sectional view showing the construction of an image forming apparatus equipped with a sheet processing apparatus according to an embodiment of the present invention. The image forming apparatus is comprised of an image forming apparatus main unit 10, and a finisher 500 implementing the sheet processing apparatus according to the embodiment. Further, the image forming apparatus main unit 10 includes an image reader 200 that reads original images, a printer 300, and an operating/display unit 400.

The image reader 200 is equipped with an original feeder 100. The original feeder 100 sequentially feeds originals set on an original tray with their front surfaces facing upward, one by one from the leading page in a leftward direction as viewed in FIG. 1, such that the originals are guided along a curved path and conveyed from the left onto a platen glass 102 and then through a moving original reading position to the right, followed by being discharged to an external discharge tray 112.

As each original passes the moving original reading position on the platen glass 102 from left to right, an image of the original is read by a scanner unit 104 held in a position corresponding to the moving original reading position. This reading method is generally called the "moving original reading method". More specifically, as the original passes the moving original reading position, a surface of the original to be scanned is irradiated with light from a lamp 103 of the scanner unit 104, and reflected light from the original is guided to a lens 108 via mirrors 105, 106, and 107. The light having passed through the lens 108 forms an image on an imaging surface of an image sensor 109.

Each original is thus conveyed so as to pass the moving original reading position from left to right, whereby scanning is performed to read the original with a direction orthogonal to the conveying direction of the original as the main scanning direction and the conveying direction of the original as the sub scanning direction. More specifically, as the original passes the moving original reading position, the image of the original is read line by line in the main scanning direction by the image sensor 109 while the original is being fed in the sub scanning direction, whereby the whole original image is read.

The original image optically read by the image sensor 109 is converted into image data by the same for output to an image signal control section 202, referred to hereinafter. The image data output from the image sensor 109 is subjected to predetermined processing by the image signal control section 202, and then discharged as a video signal to an exposure control section 110 of the printer 300.

Alternatively, it is also possible to convey the original to a predetermined position on the platen glass 102 and temporarily stop the same, and cause the scanner unit 104 to scan the original from left to right to thereby read the original. This reading method is the so-called "stationary original reading method".

In the case of reading an original without using the original feeder 100, first, a user lifts the original feeder 100 and places an original on the platen glass 102, whereafter the scanner unit 104 is caused to scan the original from left to right to read the same. In short, when the original feeder 100 is not used for reading an original, stationary original reading is performed.

The exposure control section 110 of the printer 300 modulates a laser beam based on the video signal output from the image reader 200 and then outputs the modulated laser beam. The laser beam is irradiated onto a photosensitive drum 111 while being scanned by a polygon mirror 110*a*. On the photosensitive drum 111, an electrostatic latent image is formed according to the scanned laser beam. When stationary original reading is performed, the exposure control section 110 outputs the laser beam such that a proper image (non-mirror image) is formed.

The electrostatic latent image formed on the photosensitive drum 111 is visualized as a developer image by a developer supplied from a developing device 113. On the other hand, a sheet is fed from a cassette 114 or 115, a manual sheet feeder 125, or a double-sided conveying path 124 and conveyed in between the photosensitive drum 111 and a transfer section 116 in timing synchronized with the start of irradiation of the laser beam. The developer image formed on the photosensitive drum 111 is transferred onto the fed sheet by the transfer section 116.

The sheet having the developer image transferred thereon is conveyed to a fixing section 117, and the fixing section 117 fixes the developer image on the sheet by heating and pressing the sheet. The sheet having passed through the fixing section 117 passes through a flapper 121 and discharge rollers 118 so as to be discharged from the printer 300 to the finisher 500 outside the image forming apparatus main unit 10.

When the sheet is to be discharged face-down, i.e. with an image-formed surface thereof facing downward, the sheet having passed through the fixing section 117 is temporarily guided into an inverting path 122 by switching operation of the flapper 121, and then, after the trailing edge of the sheet has passed through the flapper 121, the sheet is switched back and discharged from the printer 300 by the discharge rollers 118. This sheet discharge mode will be hereinafter referred to as "inverted discharge". The inverted discharge is carried out when images are sequentially formed starting with the leading page, e.g. when images read using the original feeder 100 are formed or when images output from a computer are formed. The sheets thus discharged by the inverted discharge are stacked in the correct page order.

When a hard sheet, such as an OHP sheet, is supplied from the manual sheet feeder 125, and an image is formed on this sheet, the sheet is not guided into the inverting path 122, and hence discharged by the discharge rollers 118, face-up, i.e. with an image-formed surface thereof facing upward. Further, when a double-sided printing mode for forming images on both sides of a sheet is set, the sheet is guided into the inverting path 122 by switching operation of the flapper 121, and then conveyed to a double-sided conveying path 124, followed by being fed in again between the photosensitive drum 111 and the transfer section 116 in the timing in synchronism with the start of irradiation of the laser beam. On the other hand, the sheet discharged from the printer 300 is sent to the finisher 500. The finisher 500 performs post-processing on the sheet discharged from the printer 300.

Figure 2:
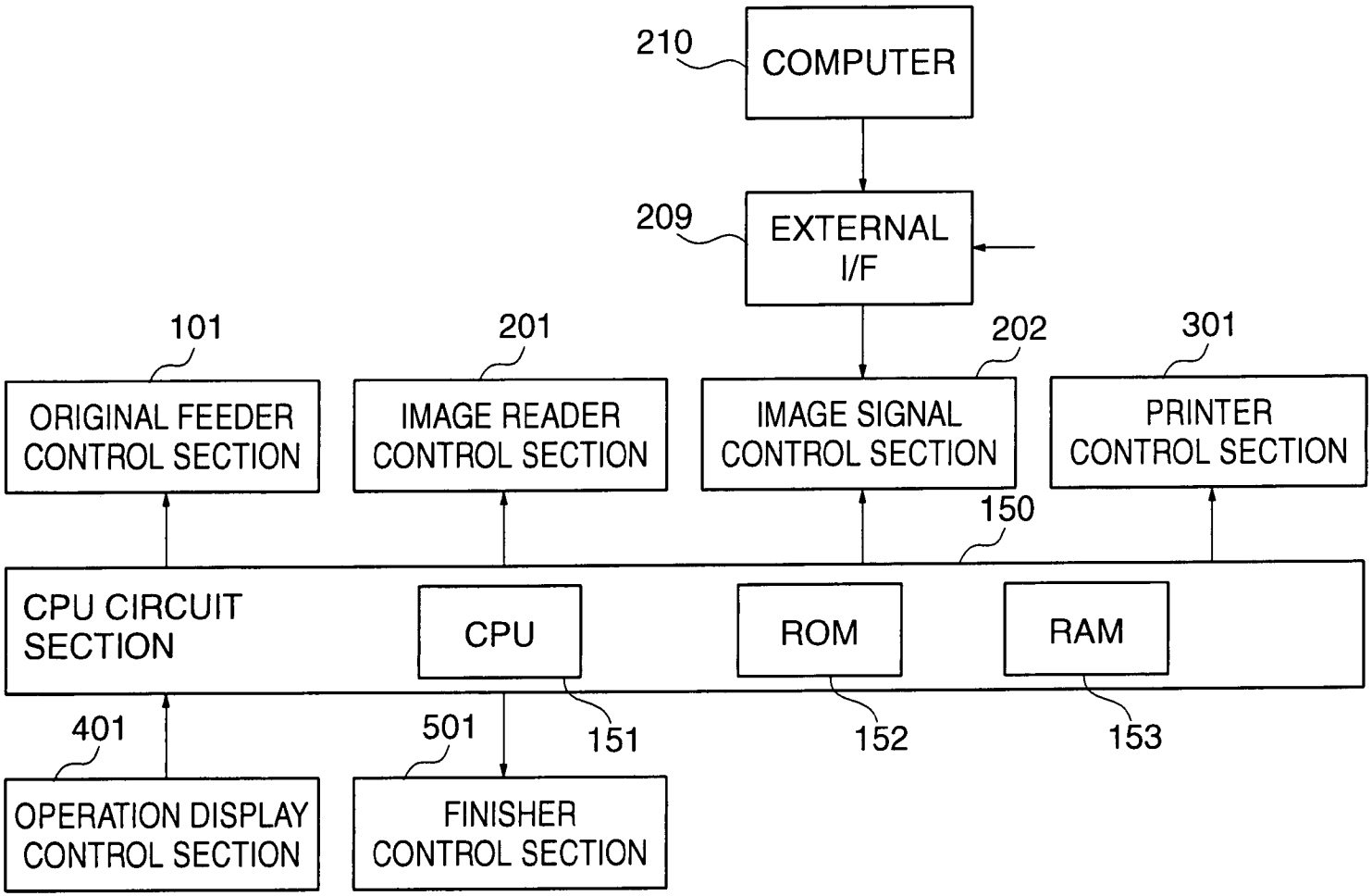
FIG. 2 is a block diagram showing the arrangement of a controller that controls the overall operation of the image forming apparatus.

FIG. 2 is a block diagram showing the arrangement of a controller that controls the overall operation of the image forming apparatus. The controller is comprised of a CPU circuit section 150, an original feeder control section 101, an image reader control section 201, the image signal control section 202, a printer control section 301, an operation display control section 401, and a finisher control section 501. An external computer 210 is connected to the image signal control section 202 via an external interface (I/F) 209.

The CPU circuit section 150 incorporates a CPU 151, a ROM 152, and a RAM 153, and performs centralized control of the above-mentioned sections, by the CPU 151 executing control programs stored in the ROM 152. The RAM 153 temporarily stores control data, and is also used as a work area for carrying out arithmetic operations when the CPU 151 executes the control programs.

The original feeder control section 101 controls the original feeder 100 according to instructions from the CPU circuit section 150. The image reader control section 201 controls the scanner unit 104, the image sensor 109, and so forth, and transfers an analog image signal output from the image sensor 109 to the image signal control section 202.

The image signal control section 202 converts the analog image signal from the image sensor 109 into a digital signal, then performs various kinds of processing on the digital signal, and converts the processed digital signal into a video signal, followed by delivering the video signal to the printer control section 301. Further, the image signal control section 202 performs various kinds of processing on a digital image signal input from the computer 210 via the external I/F 209, and converts the processed digital image signal into a video signal, followed by delivering the video signal to the printer control section 301. The operations executed by the image signal control section 202 are controlled by the CPU circuit section 150. The printer control section 301 drives the exposure control section 110 based on the received video signal.

The finisher control section 501 is incorporated in the finisher 500, and exchanges information with the CPU circuit section 150 to thereby control the overall operation of the finisher 500. Details of this control will be described hereinafter.

The operation display control section 401 controls exchange of information with the operating/display unit 400 and the CPU circuit section 150. The operating/display unit 400 includes a plurality of keys for configuring various functions for image formation, and a display section for displaying information indicative of the configurations, as described in detail hereinafter. The operation display control section 401 outputs key signals corresponding to respective operations of keys to the CPU circuit section 150, and displays the corresponding pieces of information on the display section based on signals from the CPU circuit section 150.

Figure 3:
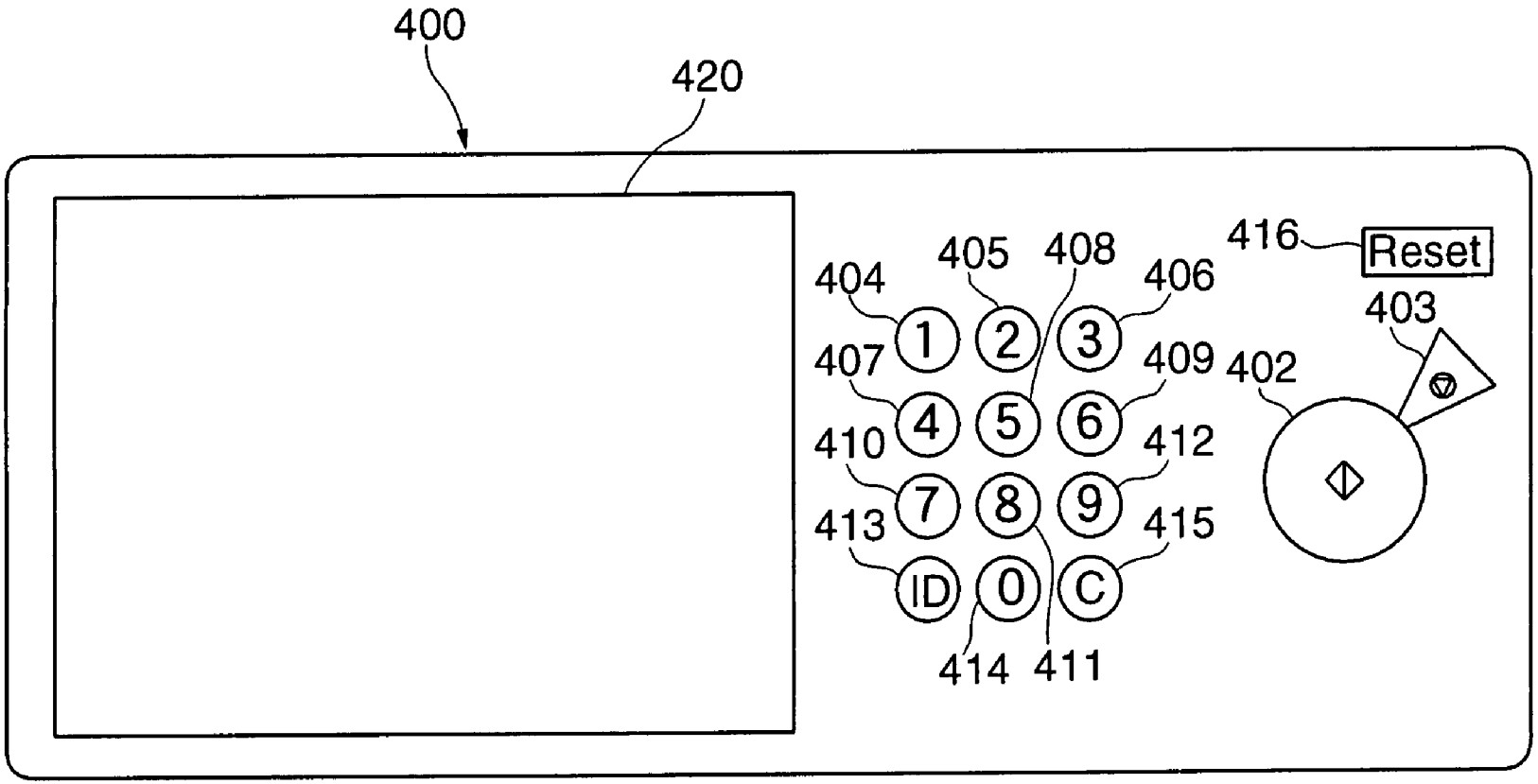
FIG. 3 is a view showing the appearance of an operating/display unit.

FIG. 3 is a view showing the appearance of the operating/display unit 400. On the operating/display unit 400, there are arranged a start key 402 for starting image forming operation, a stop key 403 for interrupting the image forming operation, a ten-key numeric keypad including keys 404 to 412 and 414 for setting input numbers, an ID key 413, a clear key 415, a reset key 416, and so forth.

Further, the operating/display unit 400 includes a liquid crystal display 420 formed with a touch panel, on which soft keys are provided. For example, the image forming apparatus of the present invention has a non-sorting mode (group mode), a sorting mode, a stapling sorting mode (binding mode), and so forth, as post-processing modes of the finisher 500. These modes are set or configured by input operations through the operating/display unit 400.

Figure 4A:
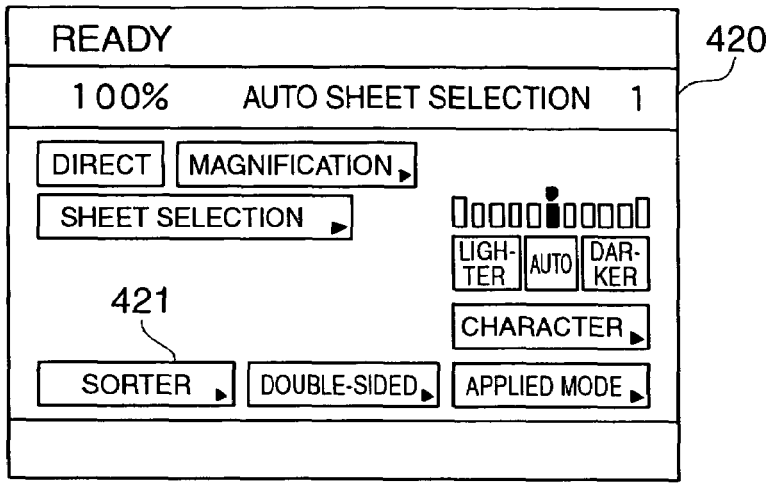
FIGS. 4A to 4C are views showing soft keys arranged on a display section of the operating/display unit.
Figure 4B:
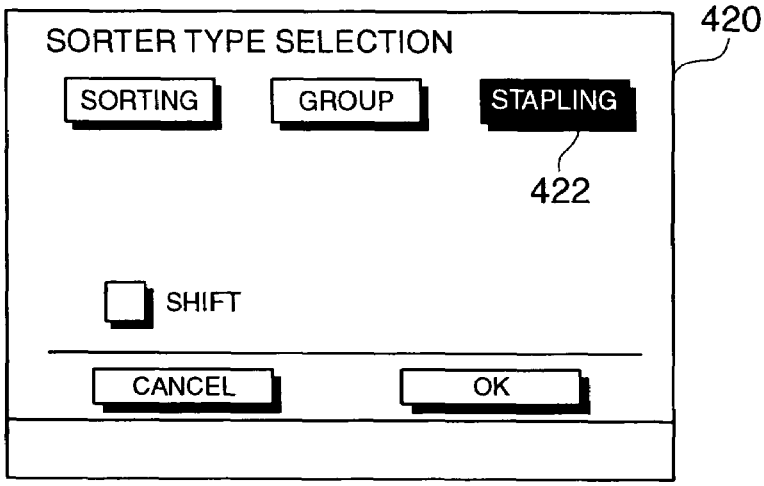
Figure 4C:
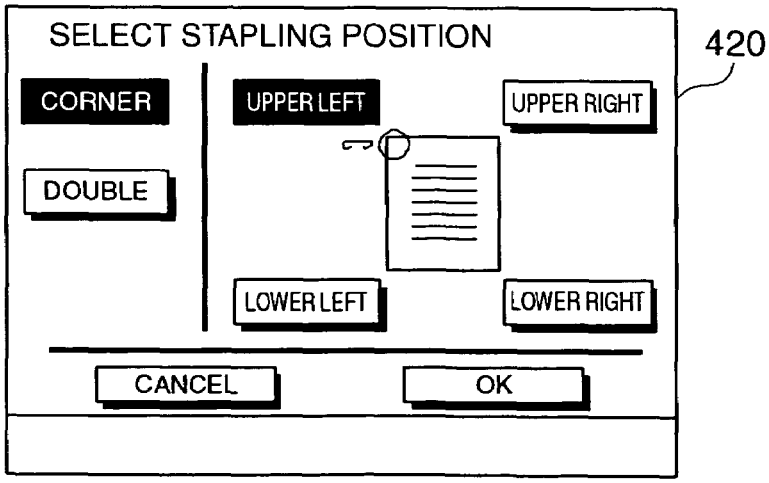

FIGS. 4A to 4C are views illustrating soft keys arranged on the display 420 of the operating/display unit 400. When a "sorter" key 421 as a soft key is selected on an initial screen of the display 420 shown in FIG. 4A, a menu option-selecting screen shown in FIG. 4B is displayed, and the processing mode is configured on the menu option-selecting screen. When a "stapling" key 422 as a soft key is selected on the menu option-selecting screen, a stapling position-setting screen shown in FIG. 4C is displayed.

Figure 5:
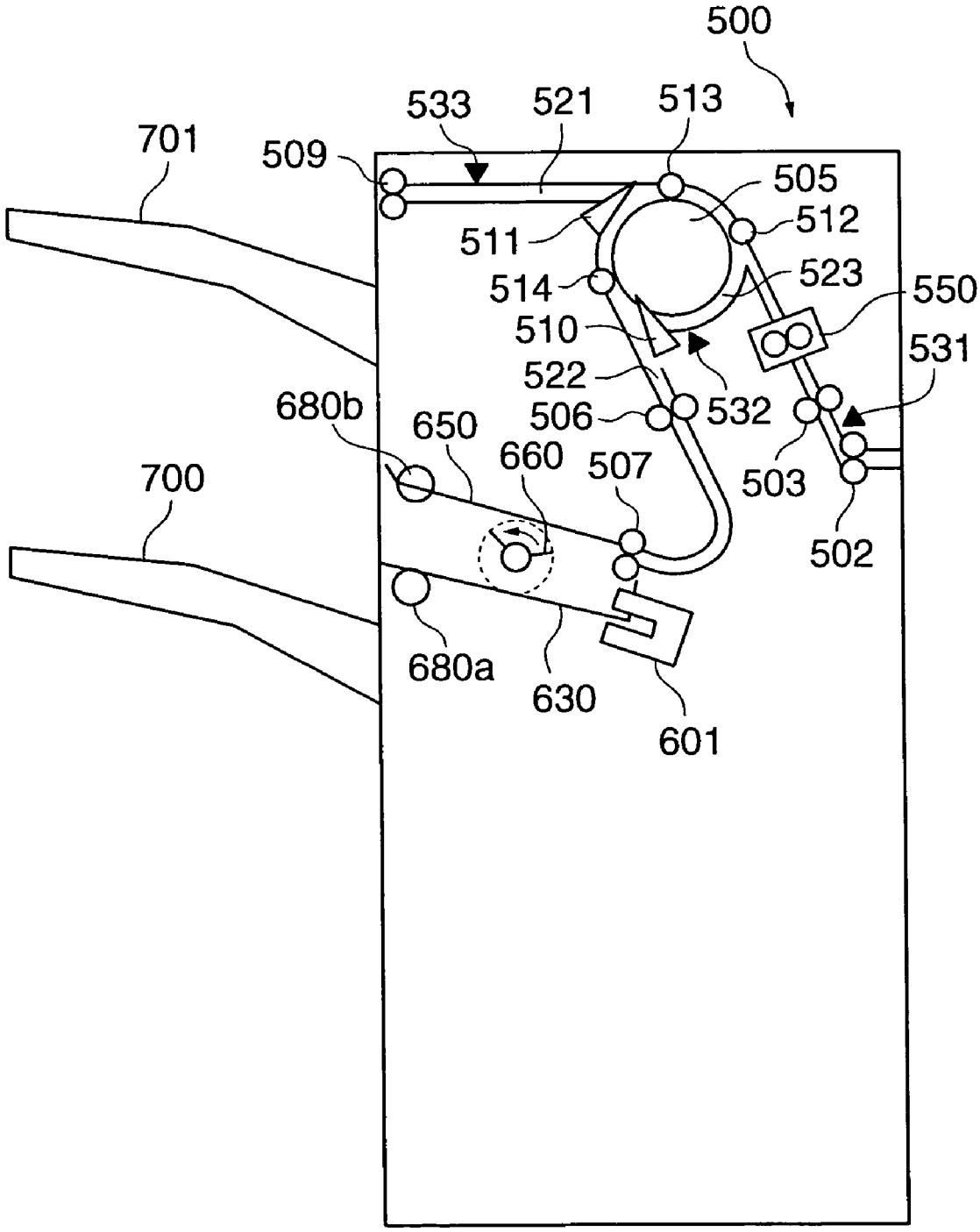
FIG. 5 is a longitudinal cross-sectional view showing the construction of a finisher.

FIG. 5 is a longitudinal cross-sectional view showing the construction of the finisher 500. The finisher 500 performs various types of post-processing including processing for sequentially taking in sheets discharged from the image forming apparatus main unit 10 and aligning the sheets taken in into a bundle, a stapling process for stapling the trailing end of the sheet bundle by a stapler, a punching process for punching holes in the trailing end of the sheet bundle, a sorting process for sorting sheets taken in, and a non-sorting process.

In the state of the finisher 500 being connected to the image forming apparatus main unit 10, if a sheet is discharged from the image forming apparatus main unit 10 by inverted discharge, with an image-formed surface thereof facing downward, the finisher 500 performs stapling and other types of processing on the fed sheet with the image-formed surface thereof facing downward.

The finisher 500 takes in a sheet discharged from the image forming apparatus main unit 10 by an inlet roller pair 502, and conveys the sheet taken in to a buffer roller 505 via a conveying roller pair 503. An inlet sensor 531 is disposed in a conveying path between the inlet roller pair 502 and the conveying roller pair 503. In a conveying path between the conveying roller pair 503 and the buffer roller 505, there is disposed a punching unit 550 which is operated, as required, to punch holes in a sheet conveyed thereto in the vicinity of the trailing edge thereof.

The buffer roller 505 is capable of winding a predetermined number of sheets conveyed thereto around the outer periphery thereof, and has pressing rollers 512, 513, and 514 provided around the outer periphery thereof, for winding sheets therearound. The sheets wound around the outer periphery of the buffer roller 505 are conveyed in the direction of rotation (counterclockwise rotation, as viewed in FIG. 5) of the buffer roller 505.

A switching flapper 511 is disposed between the pressing rollers 513 and 514, while a switching flapper 510 is disposed at a location downstream of the pressing roller 514. The switching flapper 511 peels off the sheets wound around the buffer roller 505 to guide the same into a non-sorting path 521 or keeps the same in the state wound around the buffer roller 505. On the other hand, the switching flapper 510 peels off the sheets wound around the buffer roller 505 to guide the same into the sorting path 522, or simply guides the same into a buffer path 523, in the state wound around the buffer roller 505.

When the sheets wound around the buffer roller 505 are to be guided into the non-sorting path 521, the switching flapper 511 is operated to peel off the sheets wound around the buffer roller 505 to guide the same into the non-sorting path 521. The sheets guided into the non-sorting path 521 are discharged onto a sample tray 701 via a discharge roller pair 509. In an intermediate portion of the non-sorting path 521, there is disposed a sheet discharge sensor 533.

When the sheets wound around the buffer roller 505 are to be guided into the buffer path 523, neither the switching flapper 510 nor the switching flapper 511 is operated, and the sheets are sent into the buffer path 523 in the state wound around the buffer roller 505. In an intermediate portion of the buffer path 523, there is disposed a buffer path sensor 532 that detects a sheet on the buffer path 523.

Further, when the sheets wound around the buffer roller 505 are to be guided into the sorting path 522, not the switching flapper 511 but the switching flapper 510 is operated to peel off the sheets wound around the buffer roller 505 to guide the sheets into the sorting path 522. The sheets guided into the sorting path 522 are stacked onto an intermediate tray (hereinafter referred to as the processing tray) 630 via conveying roller pairs 506 and 507. The sheets stacked on the processing tray 630 as a bundle are subjected to the aligning processing, the stapling process, and so forth, as required, followed by being discharged onto a stack tray 700 by discharge rollers 680*a* and 680*b*.

The discharge roller 680*b* is supported by a swinging guide 650. The swinging guide 650 is swung by a swinging motor 660 to bring the discharge roller 680*b* into contact with a top sheet of a sheet bundle on the processing tray 630. The discharge roller 680*b* in contact with the top sheet on the processing tray 630 cooperates with the discharge roller 680*a* to discharge the sheet bundle on the processing tray 630 toward the stack tray 700.

The stapling process is performed by a stapler 601. The stapler 601 is movably disposed along the rear end of the processing tray 630 such that the stapler 601 can staple the trailing end (right-side end, as viewed in FIG. 5) of a sheet bundle stacked on the processing tray 630.

Figure 6:
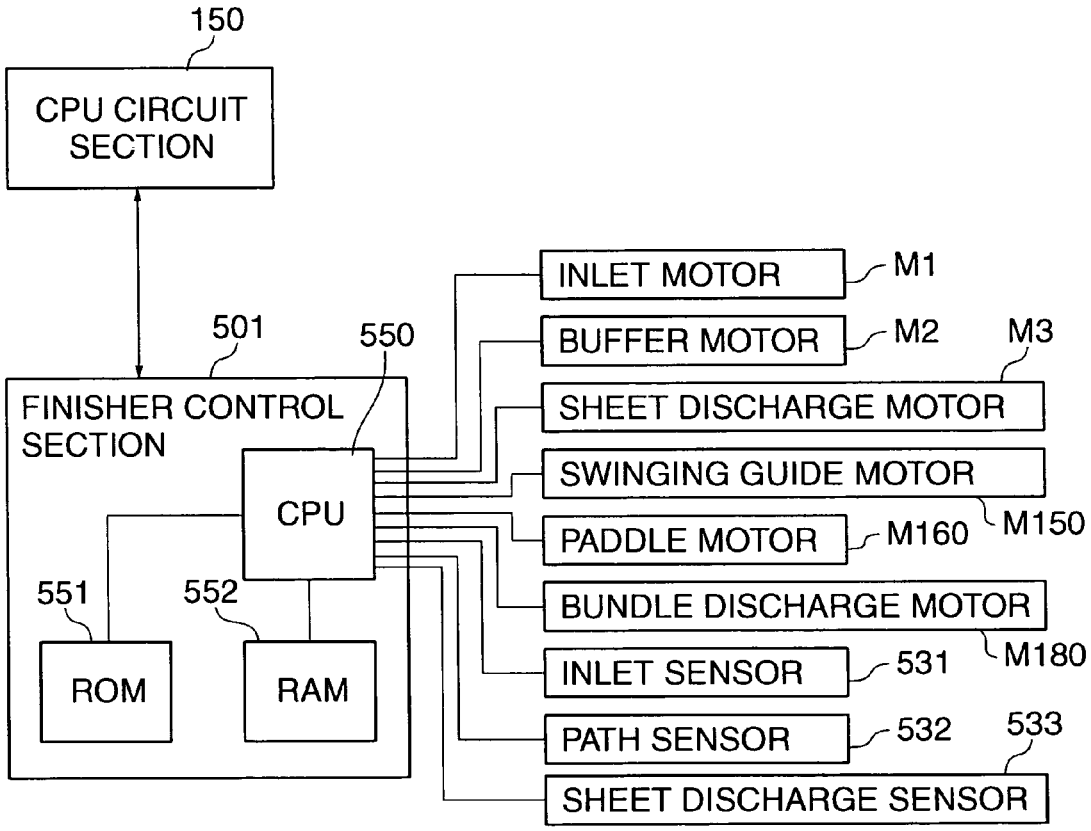
FIG. 6 is a block diagram showing the arrangement of a finisher control section.

FIG. 6 is a block diagram showing the arrangement of the finisher control section 501. The finisher control section 501 includes a CPU 550, a ROM 551, and a RAM 552. The finisher control section 501 communicates with the CPU circuit section 150 provided in the image forming apparatus main unit 10 via a communication IC, not shown, for data exchange, and executes various programs stored in the ROM 551 to control the driving of the finisher 500 according to instructions from the CPU circuit section 150. Connected to the CPU 550 are an inlet motor M1, a buffer motor M2, a sheet discharge motor M3, a swinging guide motor M150, a paddle motor M160, a bundle discharge motor M180, the inlet sensor 531, the buffer path sensor 532, the sheet discharge sensor 533, and so forth.

Figure 7:
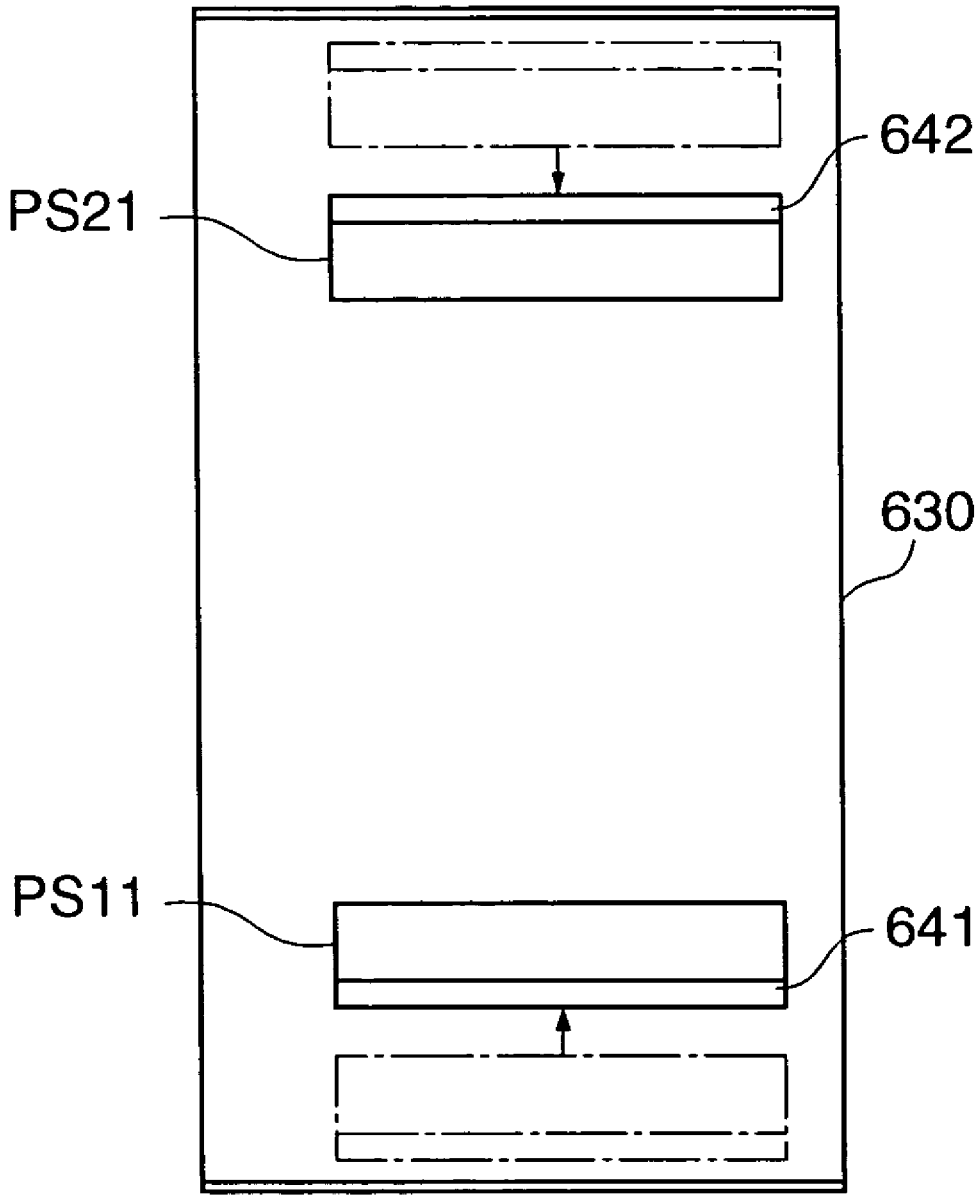
FIG. 7 is a view useful in explaining an aligning operation carried out on a processing tray.
Figure 8:
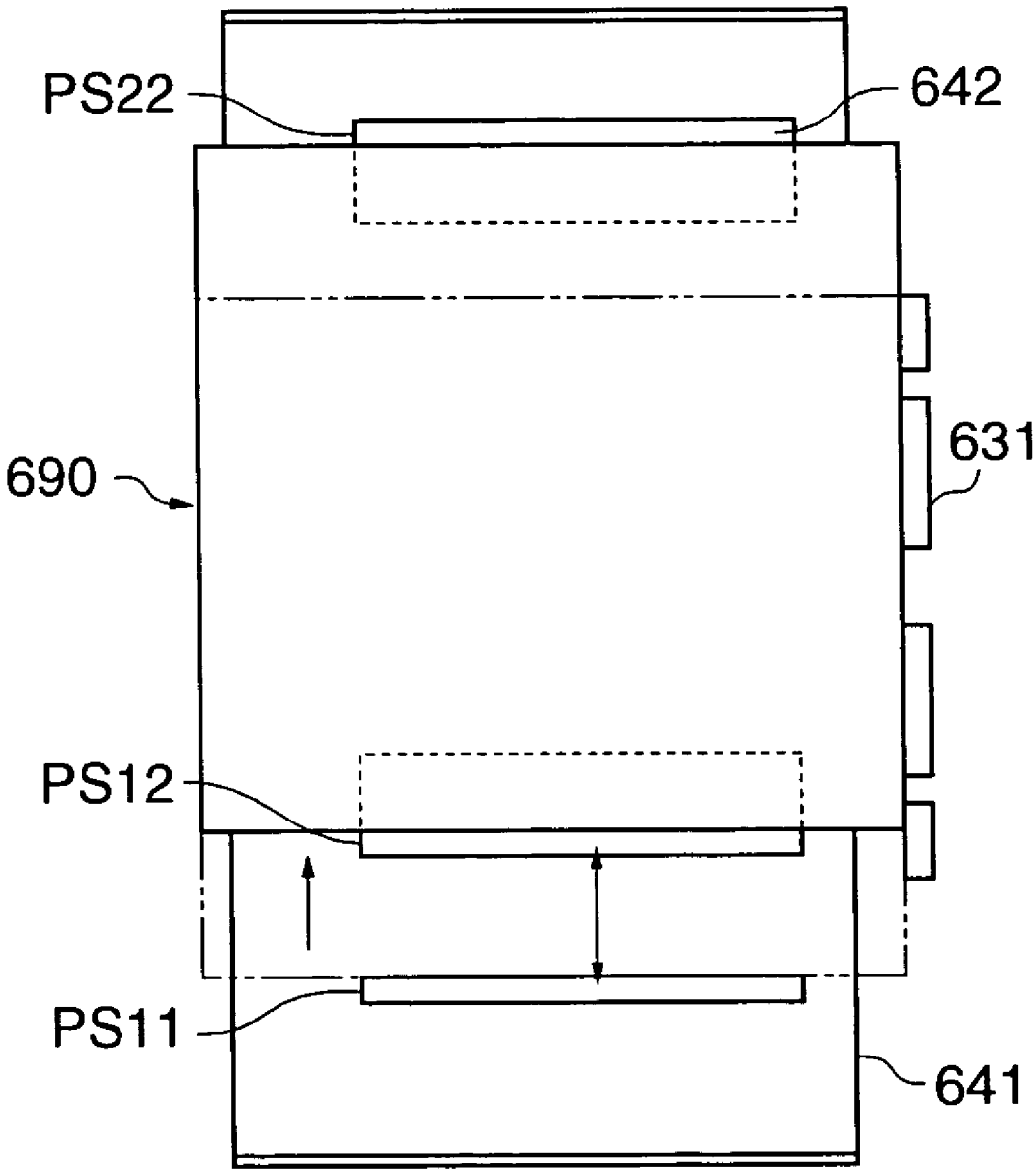
FIG. 8 is a view useful in explaining the aligning operation carried out on the processing tray.
Figure 9:
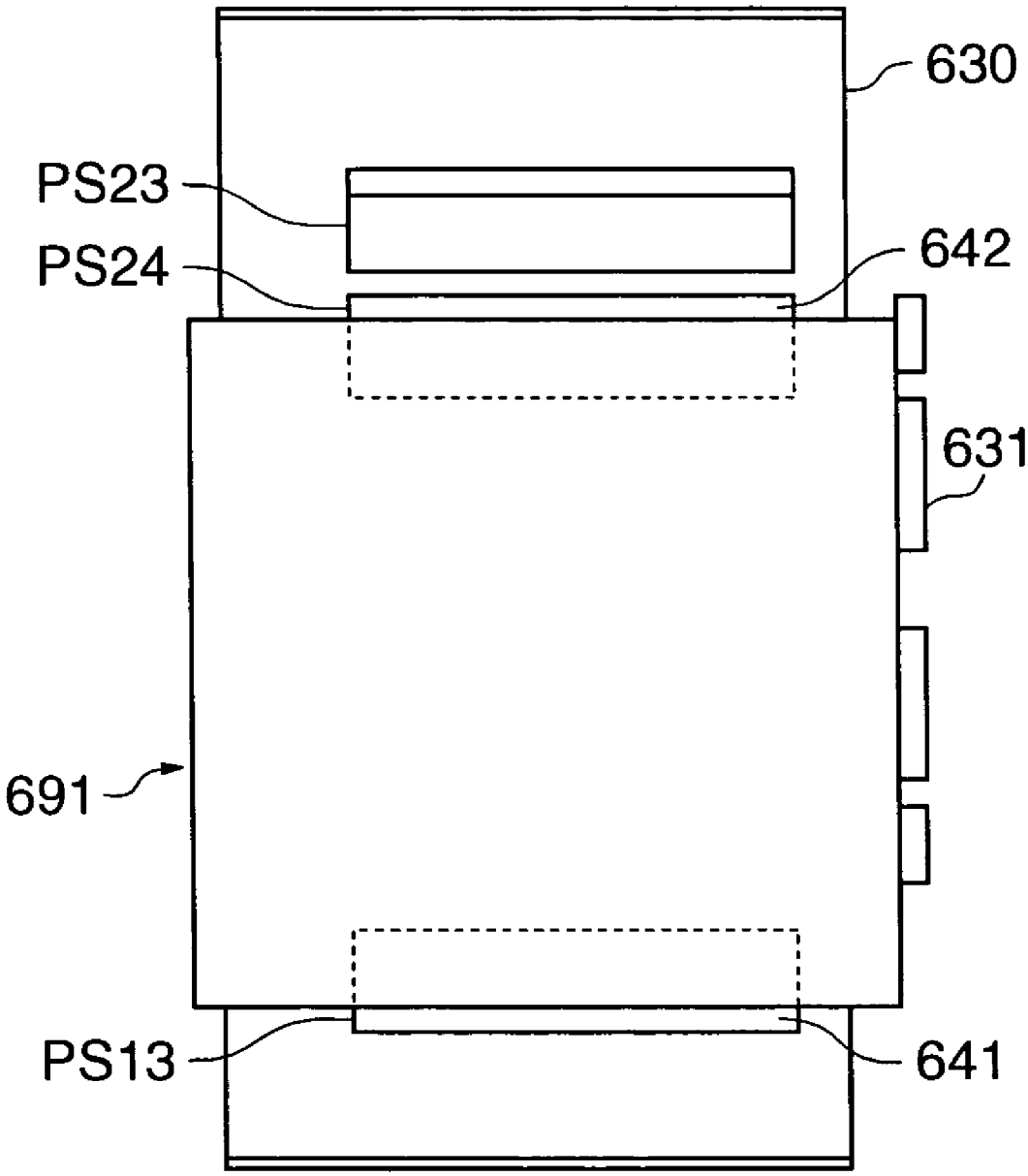
FIG. 9 is a view useful in explaining the aligning operation carried out on the processing tray.

FIGS. 7, 8, and 9 are views useful in explaining an aligning operation carried out on the processing tray 630. When a first sheet is discharged from the image forming apparatus main unit 10 onto the processing tray 630, laterally inner-side and outer-side aligning members 641 and 642 having been on standby at respective home positions (indicated by one-dot-chain lines) are moved to respective positions PS11 and PS21 to define space therebetween which is slightly larger in width than the width of sheets sequentially discharged (see FIG. 7).

When the sheet discharged onto the processing tray 630 falls in between the aligning members 641 and 642 with a trailing edge thereof supported by a stopper 631, the aligning member 641 is moved to a position PS12 in timing in which the underside surface of the discharged sheet comes into contact with a support surface of the processing tray 630 (see FIG. 8). As a result, the sheet is moved by the aligning member 641 to be aligned with a first alignment position 690. Here, a central position on a sheet in the transverse direction thereof is referred to as an alignment position for convenience of description. After aligning the first sheet, the aligning member 641 returns to the position PS11, and is placed on standby there until a second sheet is discharged onto the processing tray 630.

When the second sheet is discharged onto the processing tray 630, the aligning member 641 is moved again to the position PS12 to align the sheet with the first alignment position 690. At this time, the inner-side aligning member 642 is held in the state standing in a position PS22 to play the role of an alignment reference. The operation described above is continuously carried out until alignment of a final sheet of one sheet bundle is completed. After completion of the discharge and alignment of the sheets that form the first sheet bundle (i.e. the first copy), the sheets are discharged onto the stack tray 700.

After the first sheet bundle is discharged onto the stack tray 700, the aligning member 641 is moved from the position PS12 to a position PS13, and the aligning member 642 is moved from the position PS22 to a position PS23 (see FIG. 9).

Subsequently, when a first sheet (leading sheet) for a second sheet bundle (i.e. a second copy) is discharged onto the processing tray 630, as in the case of the first sheet bundle, the sheet falls in between the aligning members 641 and 642 with a trailing edge thereof supported by the stopper 631. Then, the aligning member 642 is moved from the position PS23 to a position PS24 in timing in which the underside surface of the discharged sheet comes into contact with the support surface of the processing tray 630.

As a result, the sheet is moved by the aligning member 642 to be aligned with a second alignment position 691. Before each of second and following sheets is discharged, the aligning member 642 is moved to the position PS23, and is placed on standby there until a succeeding sheet is discharged onto the processing tray 630.

When the succeeding sheet is discharged onto the processing tray 630, the aligning member 642 is moved again to the position PS24 to align the sheet with the second alignment position 691. At this time, the outer-side aligning member 641 is held in the state standing in the position PS13 to play the role of an alignment reference. The operation described above is continuously carried out until alignment of a final sheet of one sheet bundle is completed. After completion of the discharge and alignment of the sheets that form the second sheet bundle (i.e. the second copy), the second sheet bundle is discharged onto the stack tray 700. In this case, the sheet bundle aligned with the first alignment position 690 is at a location offset laterally inward of the sheet bundle aligned with the second alignment position 691, by a predetermined distance (offset distance L).

Figure 10:
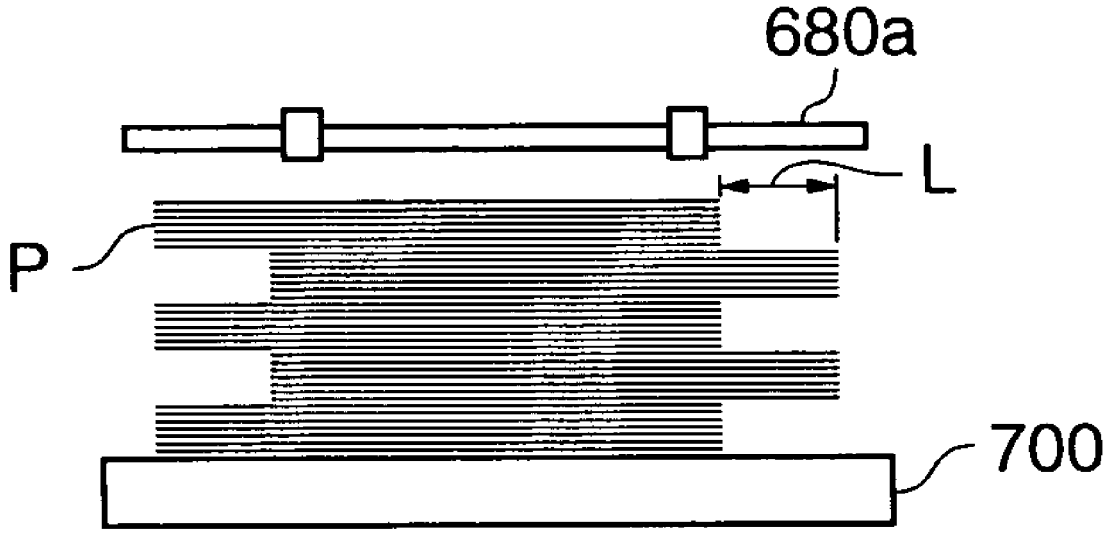
FIG. 10 is a view showing a plurality of sheet bundles stacked on a stack tray when an alignment position is changed alternately on a sheet bundle-by-sheet bundle basis.

Thus, the aligning operation is performed for changing the alignment position alternately on a sheet bundle-by-sheet bundle basis. FIG. 10 is a view showing a plurality of sheet bundles stacked on the stack tray 700 by changing the alignment position alternately on a sheet bundle-by-sheet bundle basis. The alternate changes in the alignment position sort the sheet bundles such that they are alternately offset from each other by the offset distance L.

It should be noted that the offset distance L is set to respective different values for the sorting mode and the stapling sorting mode. For example, the offset distance L for the stapling sorting mode is set to a distance L1 that prevents staples that bind respective adjacent sheet bundles from being overlapped one upon another in the stacked state of the sheet bundles. On the other hand, the offset distance L for the sorting mode is set to a distance L2 that enables the sheet bundles to be reliably distinguished from each other. These offset distances L1 and L2 are set such that L1<L2 holds, so that the sorting process in the stapling sorting mode can be sped up.

Figure 11:
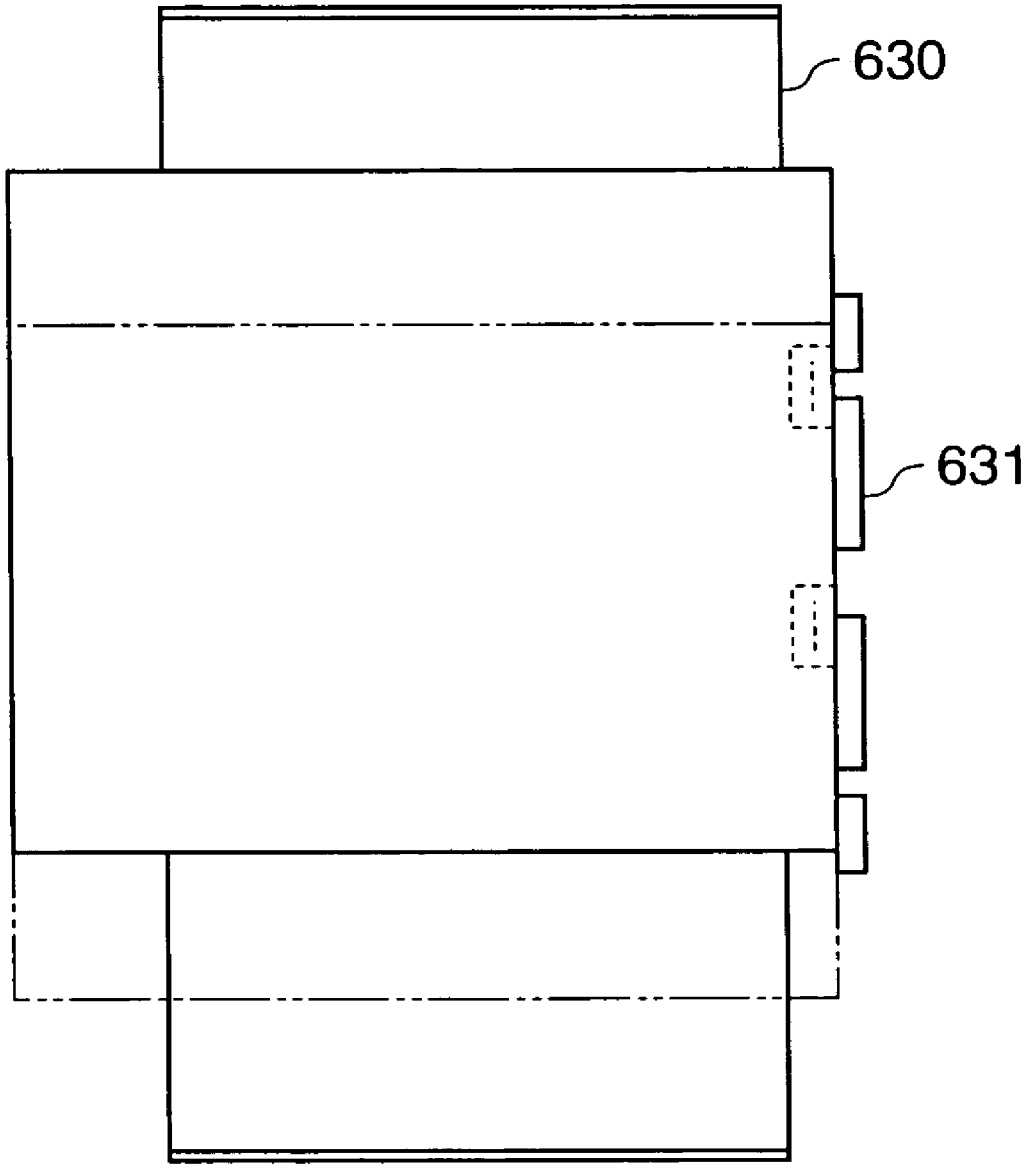
FIG. 11 is a view useful in explaining a two-point binding mode.
Figure 12:
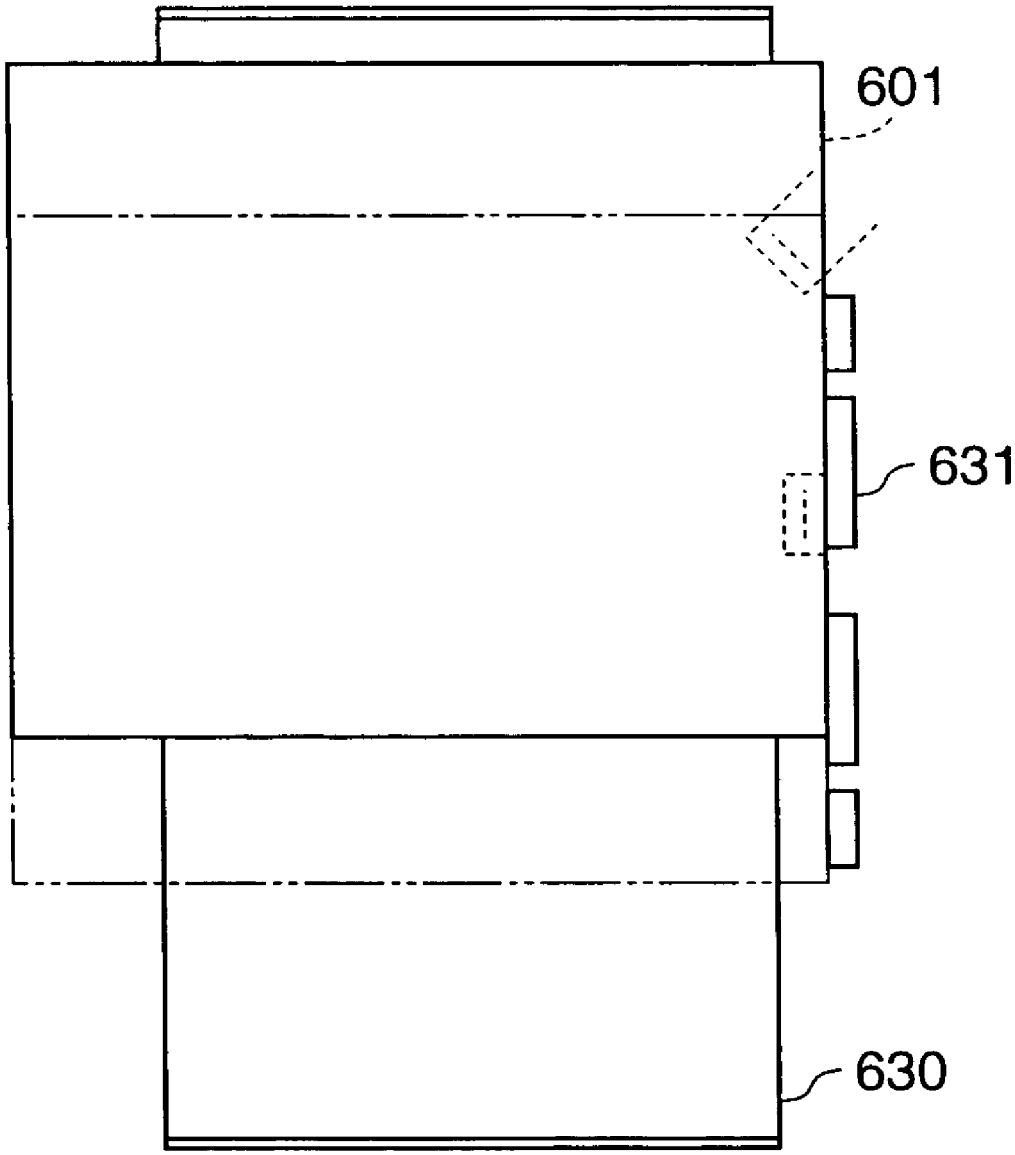
FIG. 12 is a view useful in explaining an inner-side oblique binding mode.
Figure 13:
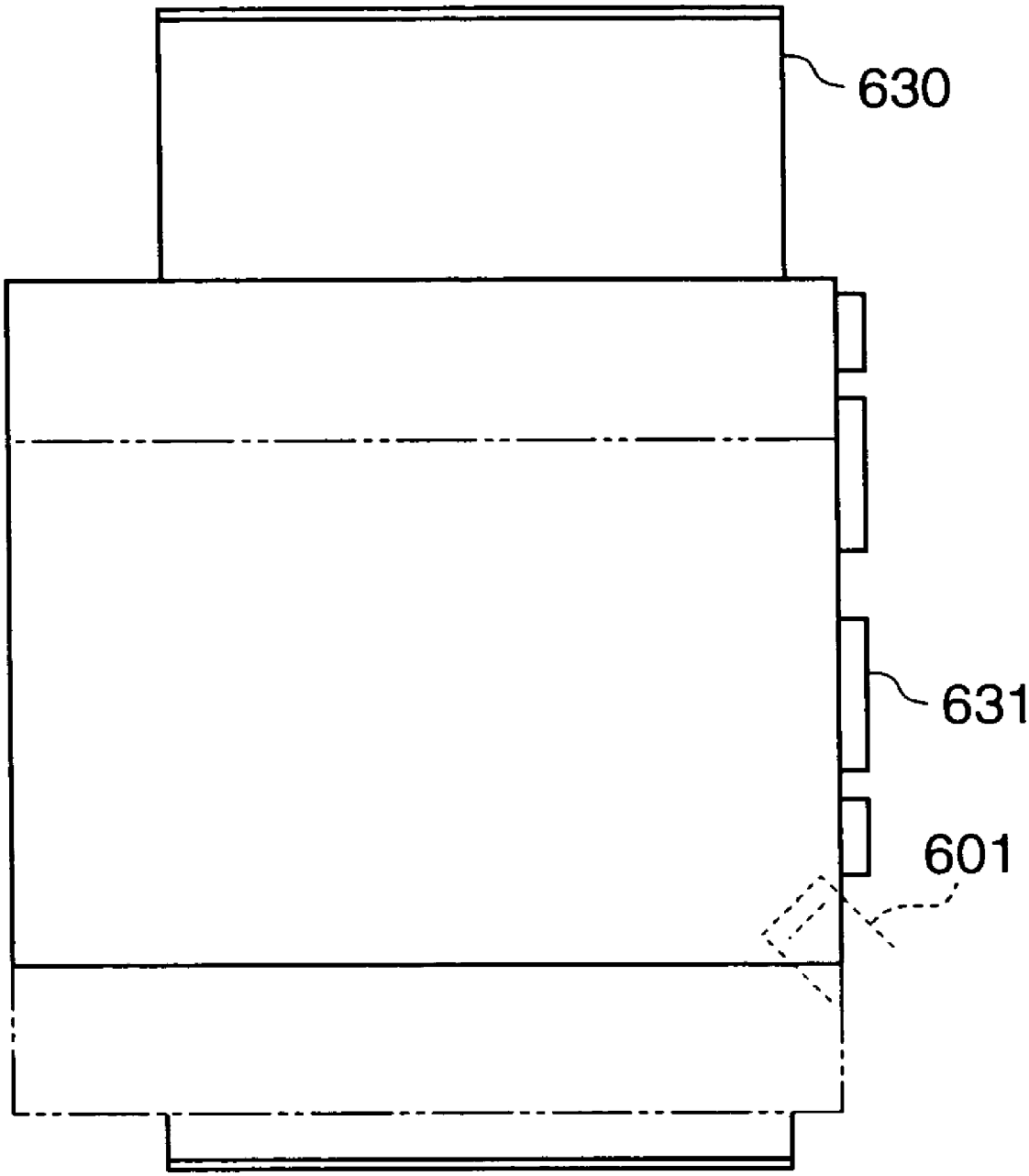
FIG. 13 is a view useful in explaining an outer-side oblique binding mode.

Now, a description will be given of a stapling operation. In the present embodiment, the binding mode of the stapling operation by the stapler 601 includes a plurality of stapling modes, such as a one-point binding mode for outer-side oblique binding and inner-side oblique binding, and a two-point binding mode. FIG. 11 is a view useful in explaining the two-point binding mode. FIG. 12 is a view useful in explaining an inner-side oblique binding mode, and FIG. 13 is a view useful in explaining an outer-side oblique binding mode. It should be noted that in FIGS. 11 to 13, solid lines represent sheets aligned with the first alignment position 690, and two-dot chain lines represent sheets aligned with the second alignment position 691.

In the stapling mode, the stapler 601 is on standby at a predetermined clinch position during alignment of each sheet, and then when the discharge and alignment of a final sheet of one sheet bundle is completed, the stapler 601 is moved by the offset distance L1 set for the sheet bundle, and carries out the stapling operation. The stapler 601 is moved with its orientation changed according to the binding mode (the outer-side oblique binding mode, the inner-side oblique binding mode, or the two-point binding mode).

In the two-point binding mode, a stapling operation for stapling the trailing end of a sheet bundle aligned with the alignment position 690 or 691 at two points is performed (see FIG. 11). In the inner-side oblique binding mode, a stapling operation for stapling the trailing end of a sheet bundle aligned with the alignment position 690 or 691 with the stapler 601 in a laterally inner oblique position is performed (see FIG. 12). Further, in the outer-side oblique binding mode, a stapling operation for stapling the trailing end of a sheet bundle aligned with the alignment position 690 or 691 with the stapler 601 in a laterally outer oblique position is performed (see FIG. 13).

When the alignment position of sheets to be discharged is located toward the outer-side of the processing tray 630, the inner-side aligning member 642 makes reciprocating movement to shift each sheet toward the outer-side aligning member 641 as the alignment reference. On the other hand, when the alignment position of the sheets to be discharged is located toward the inner side of the processing tray 630, the outer-side aligning member 641 makes reciprocating movement to shift each sheet toward the inner-side aligning member 642 as the alignment reference.

Next, a description will be given of a bundle discharge operation in the stapling mode. In a one-point stapling sorting mode, when the aligning operation described hereinbefore is completed, a stapling operation by the stapler 601 is started. Further, speed control of the swinging guide motor M150 is performed such that lowering of the swinging guide 650 is started during the aligning operation or the stapling operation and the discharge roller 680*b* reaches a sheet bundle immediately before or after completion of the stapling operation.

The timing in which the lowering of the swinging guide 650 is started is changed according to the number of the sheets of a sheet bundle stacked on the processing tray 630. More specifically, when the number of the sheets of a sheet bundle is small, the distance the discharge roller 680*b* travels to reach the sheet bundle is long whereas the operation time of the stapler 601 is short, and hence the lowering of the swinging guide 650 is started at an early stage of the aligning operation. On the other hand, when the number of the sheets of a sheet bundle is large, the distance the discharge roller 680*b* travels to reach the sheet bundle is short whereas the operation time of the stapler 601 is long, and hence the lowering of the swinging guide 650 is started almost simultaneously with the start of the stapling operation.

When a predetermined time period has elapsed, which is required for the discharge roller 680*b* to stop bounding after the discharge roller 680*b* has reached the sheet bundle, it is determined whether or not the stapling operation is completed. If the stapling operation is completed, the sheet bundle is discharged onto the stack tray 700 by the discharge rollers 680*a* and 680*b*. On the other hand, if the stapling operation is not completed, the completion of the stapling operation is awaited.

In discharging a sheet bundle onto the stack tray 700 after completion of the stapling operation, control of the discharge speed of the sheet bundle is carried out. That is, the discharge speed is controlled such that the sheet bundle is conveyed at a relatively high speed after the start of the sheet conveyance, and the discharge speed of the sheet bundle is reduced immediately before the trailing end of the sheet bundle leaves the discharge rollers 680*a* and 680*b*, to a suitable discharge speed for stacking onto the stack tray 700.

On the other hand, in a two-point stapling sorting mode, when the stapler 601 is moved to a stapling position where a sheet bundle is to be stapled at a second point after completion of a stapling operation for stapling the sheet bundle at a first point, lowering of the swinging guide 650 is started. While the sheet bundle is stapled at the second point, the swinging guide 650 is on standby with the discharge roller 680*b* in contact with the sheet bundle. Then, the discharge roller 680*b* starts the bundle discharge operation upon completion of the stapling operation. Thereafter, the same operation as in the one-point binding mode is carried out.

Next, a description will be given of sheet conveyance in the finisher 500 in each of the non-sorting mode, the stapling sorting mode, and the sorting mode.

Figure 14:
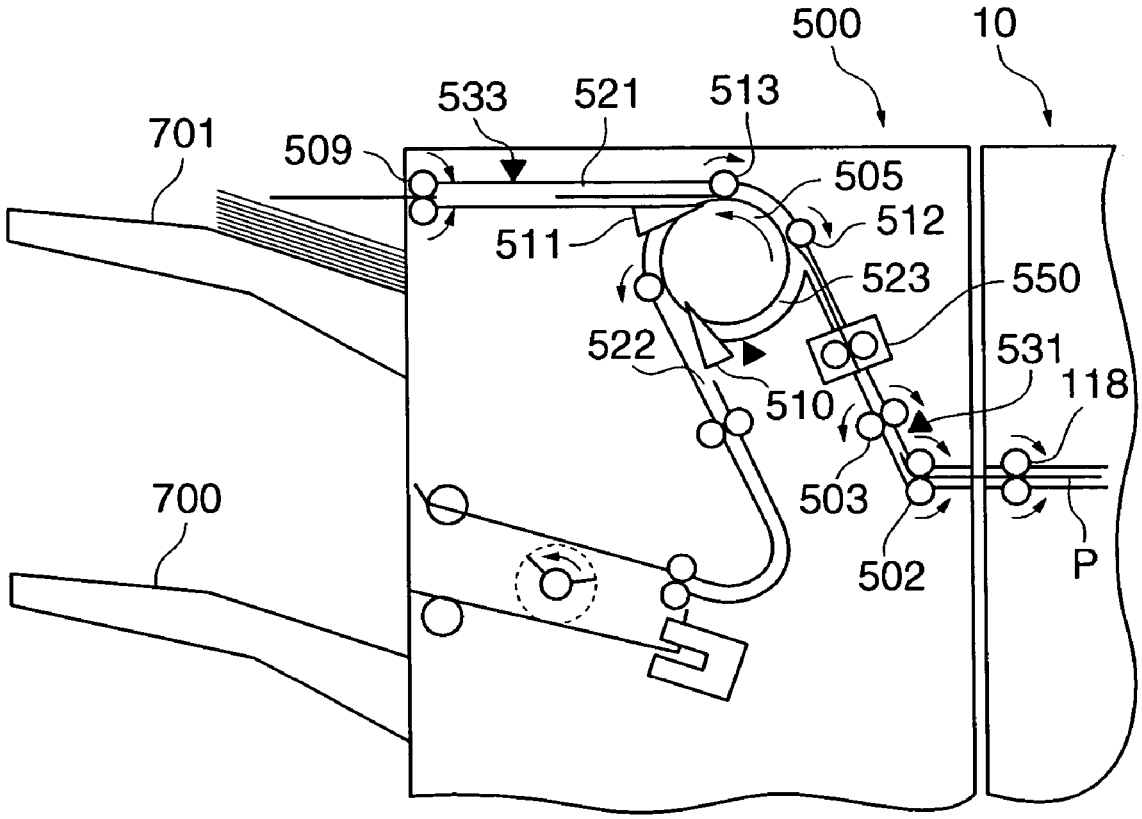
FIG. 14 is a view useful in explaining sheet conveyance in a non-sorting mode.

FIG. 14 is a view useful in explaining sheet conveyance in the non-sorting mode. When the non-sorting mode is designated by the user, the inlet roller pair 502, the conveying roller pair 503, and the buffer roller 505 are driven for rotation, whereby a sheet P discharged from the image forming apparatus main unit 10 is taken into the finisher 500 and conveyed. The switching flapper 511 is driven by a solenoid, not shown, so that the sheet P is conveyed from the buffer roller 505 to the non-sorting path 521 without being wound around the buffer roller 505. Then, when the trailing edge of the sheet P is detected by the sheet discharge sensor 533, the discharge roller pair 509 is rotated at a suitable conveyance speed for stacking sheets on the sample tray 701, whereby the sheet P is discharged onto the sample tray 701.

Figure 15:
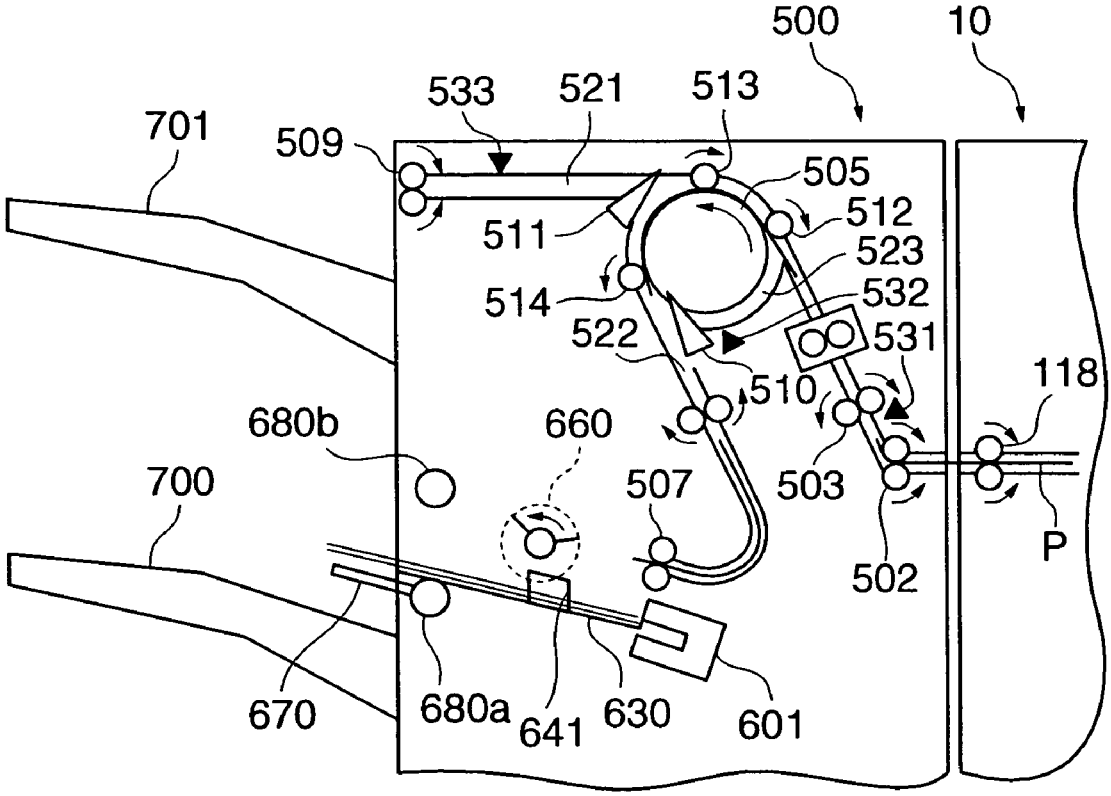
FIG. 15 is a view useful in explaining sheet conveyance in a stapling sorting mode.

FIG. 15 is a view useful in explaining sheet conveyance in the stapling sorting mode. When the stapling sorting mode is designated by the user, the inlet roller pair 502, the conveying roller pair 503, and the buffer roller 505 are driven for rotation, whereby a sheet P discharged from the image forming apparatus main unit 10 is taken into the finisher 500 and conveyed.

The switching flappers 510 and 511 are held in stoppage at respective positions shown in FIG. 15, so that the sheet P is guided into the sorting path 522. The sheet P guided into the sorting path 522 is discharged onto the processing tray 630 via the conveying roller pair 507. When the sheet P is discharged onto the processing tray 630, an auxiliary tray 670 projecting from the finisher 500 at a location slightly below the front end of the processing tray 630 prevents the sheet P discharged via the conveying roller pair 507, from hanging downward or failing to return, and facilitates alignment of sheets on the processing tray 630.

The sheet P discharged onto the processing tray 630 starts moving on the processing tray 630 toward the stopper 631 due to its own weight. This movement of the sheet P is assisted by an assisting member, such as a paddle, not shown. When the trailing edge of the sheet P is brought into contact with the stopper 631 and stopped, alignment of discharged sheets is performed by the aligning members 641 and 642. When a predetermined number of sheets P is aligned, the stapling and bundle discharge operations described above are carried out, followed by the bundle of the sheets P being discharged onto the stack tray 700. Since each sheet is discharged from the image forming apparatus main unit 10 with its image-formed surface facing downward, the bundle of the predetermined number of aligned sheets P has a leading page placed at the bottom thereof, with its image-formed surface facing downward and the following pages sequentially stacked on the leading page in page order.

Figure 16:
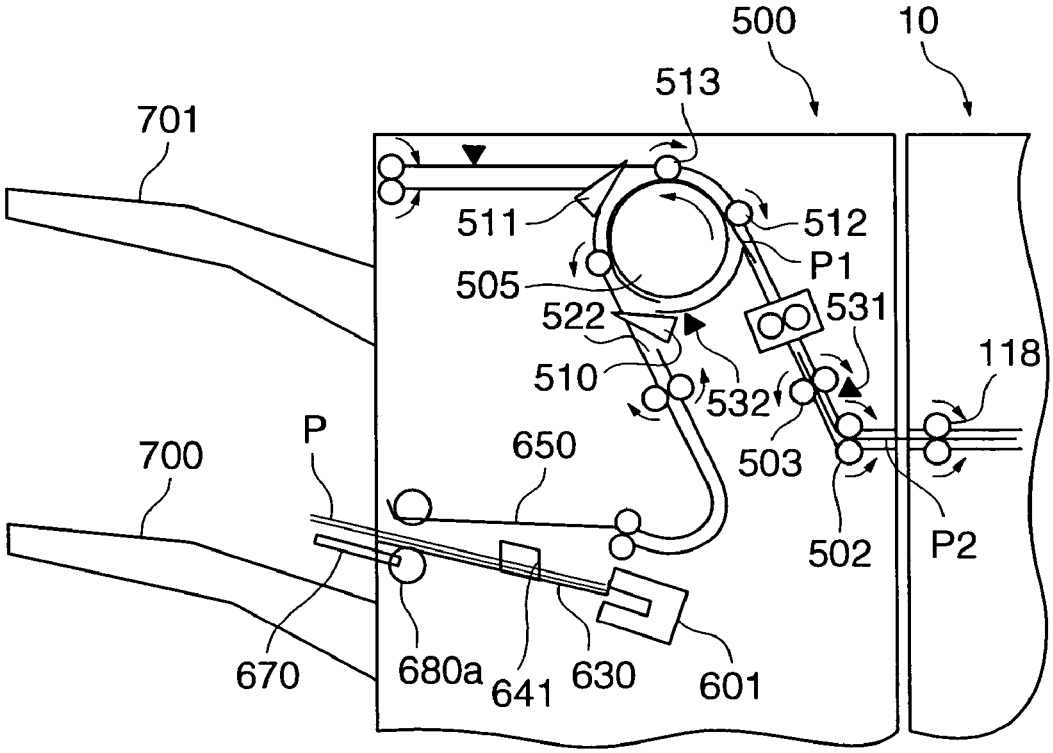
FIG. 16 is a view useful in explaining sheet conveyance in a sorting operation for a second bundle (i.e. a bundle for a second copy)
Figure 17:
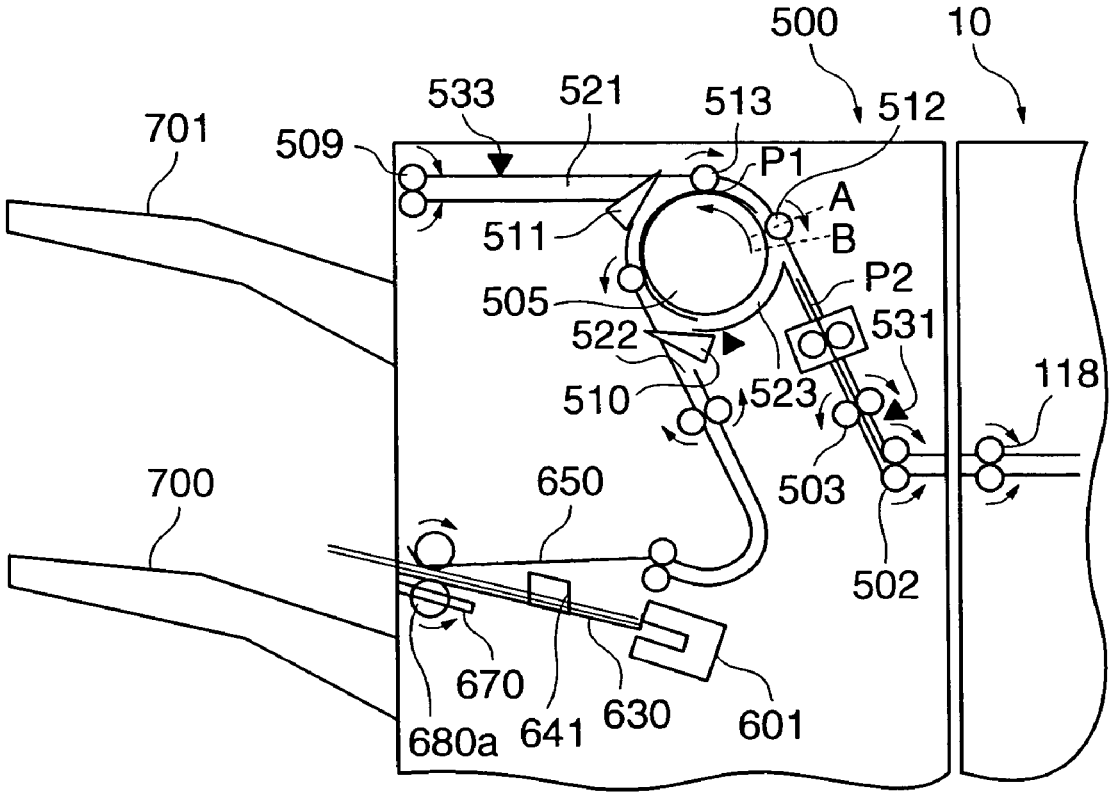
FIG. 17 is a view useful in explaining the sheet conveyance in the sorting operation for the second bundle.

Now, a description will be given of how sheets for forming a second sheet bundle (second copy) are conveyed during a time period from the start of taking-in of the sheets P for forming the first sheet bundle (first copy) to the discharge of the same as a sheet bundle. FIGS. 16 and 17 are views useful in explaining sheet conveyance during operation of sorting the second sheet bundle.

When discharged from the image forming apparatus main unit 10, a sheet P1 as a first page for forming the second sheet bundle is wound around the buffer roller 505 by the switching operation of the switching flapper 510 (see FIG. 16). The buffer roller 505 is stopped when the sheet P1 is conveyed by a predetermined distance from the buffer path sensor 532.

When the leading edge of a sheet P2 as a second page is advanced from the inlet sensor 531 by a predetermined distance (50 mm in the present embodiment, as described hereinafter), the buffer roller 505 starts to be rotated, whereby the sheet P2 is laid over the sheet P1 wound around the buffer roller 505 such that the sheet P2 is advanced from the sheet P1 by a predetermined distance (see FIG. 17). In other words, the sheet P2 is laid over the sheet P1 in a manner offset therefrom by the predetermined distance. The sheets P1 and P2 wound around the buffer roller 505 are peeled off the buffer roller 505 by the switching flapper 510 and conveyed as a two-sheet bundle P into the sorting path 522.

Figure 18:
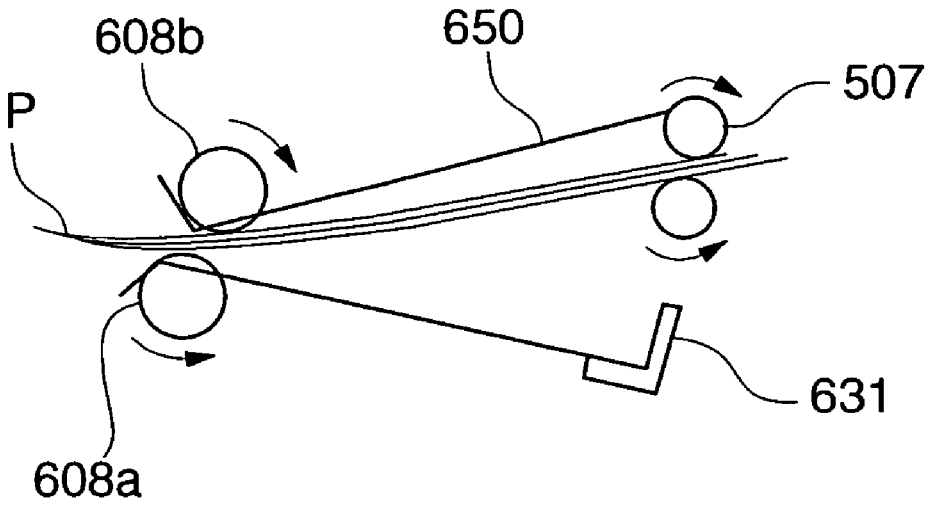
FIG. 18 is a view useful in explaining an operation of discharging a sheet bundle.

At a time point the two-sheet bundle P is conveyed into the sorting path 522, a bundle discharge operation for discharging the preceding sheet bundle P stacked on the processing tray 630 has been completed, and the swinging guide 650 is in a lowered state in contact with the sheet bundle P. FIG. 18 is a view useful in explaining the operation of discharging a sheet bundle. The two-sheet bundle P discharged via the conveying roller pair 507 is brought in between the discharge rollers 680*a* and 680*b*.

Figure 19:
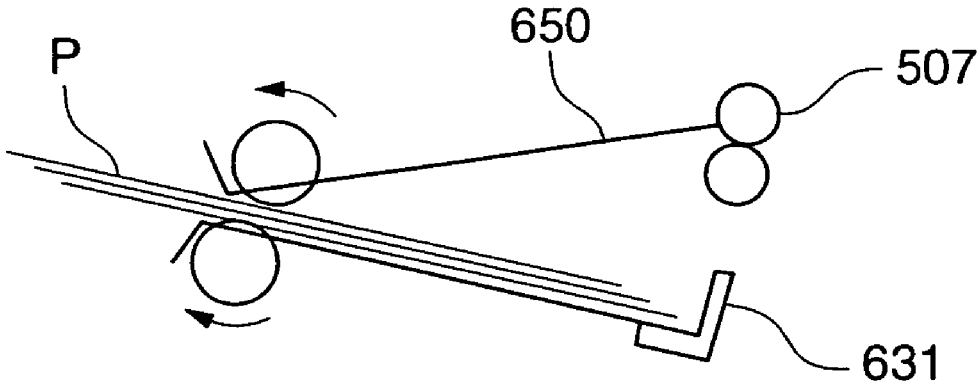
FIG. 19 is a view useful in explaining an operation of returning a sheet bundle.
Figure 20A:
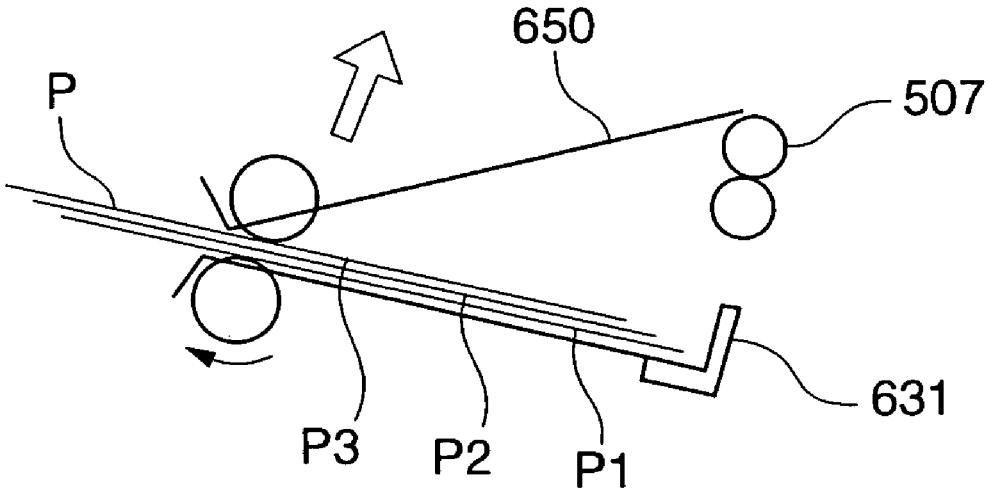
FIGS. 20A and 20B are views useful in explaining the operation of returning the sheet bundle.
Figure 20B:
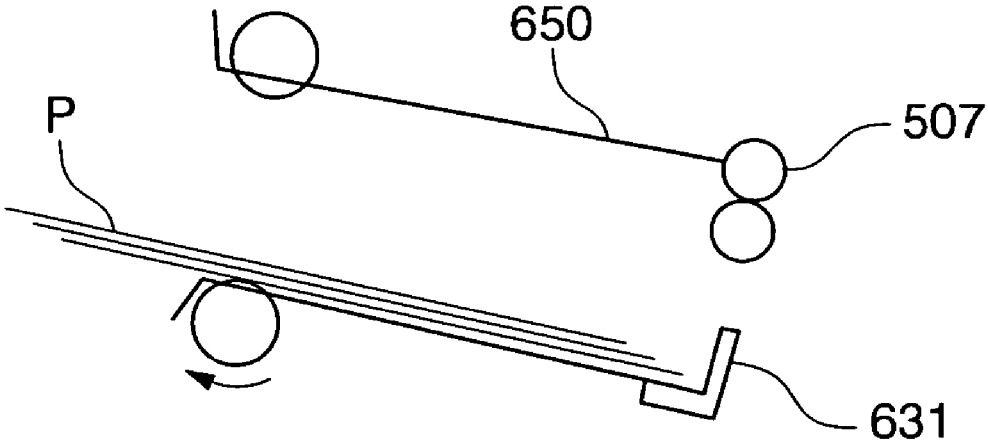

FIGS. 19, 20A and 20B are views useful in explaining the operation of returning a sheet bundle. At a time point the trailing end of a sheet bundle P passes through the conveying roller pair 507 and reaches the processing tray 630, the discharge rollers 680*a* and 680*b* are driven for reverse rotation, whereby the sheet bundle P is moved toward the stopper 631 (see FIG. 19). Before the trailing end of the sheet bundle P comes into abutment with the stopper 631, the swinging guide 650 starts to be moved upward (see FIG. 20A), and the discharge roller 680*b* is moved away from the sheet surface (see FIG. 20B).

The sheet bundle P is conveyed in a state where the sheets thereof are offset from each other in the conveying direction. More specifically, the sheet P2 is offset from the sheet P1 in a direction away from the stopper 631. The third and following sheets are discharged onto the processing tray 630 through the sorting path 522 as in the discharge operation for the first sheet bundle. After discharge of the second sheet bundle onto the stack tray 700, the same operation is repeatedly carried out, whereby a predetermined number of sheet bundles (copies) are stacked on the stack tray 700.

On the stack tray 700, the sheet bundles are stacked in a manner alternately offset from each other (see FIG. 10). Further, each of the sheet bundles has a leading page placed at the bottom thereof, with its image-formed surface facing downward and the following pages sequentially stacked on the leading page in page order.

It should be noted that although in the present embodiment, two sheets are superimposed by the buffer roller 505, this is not limitative, but three or more sheets may be superimposed on upon another. For example, in the case of superimposing three sheets, sheet conveyance for a second sheet bundle is performed similarly to the sheet conveyance described hereinbefore with reference to FIGS. 16 and 17 until a sheet P2 for a second page of the second sheet bundle is superimposed on the a sheet P1 for a first page of same.

Figure 21:
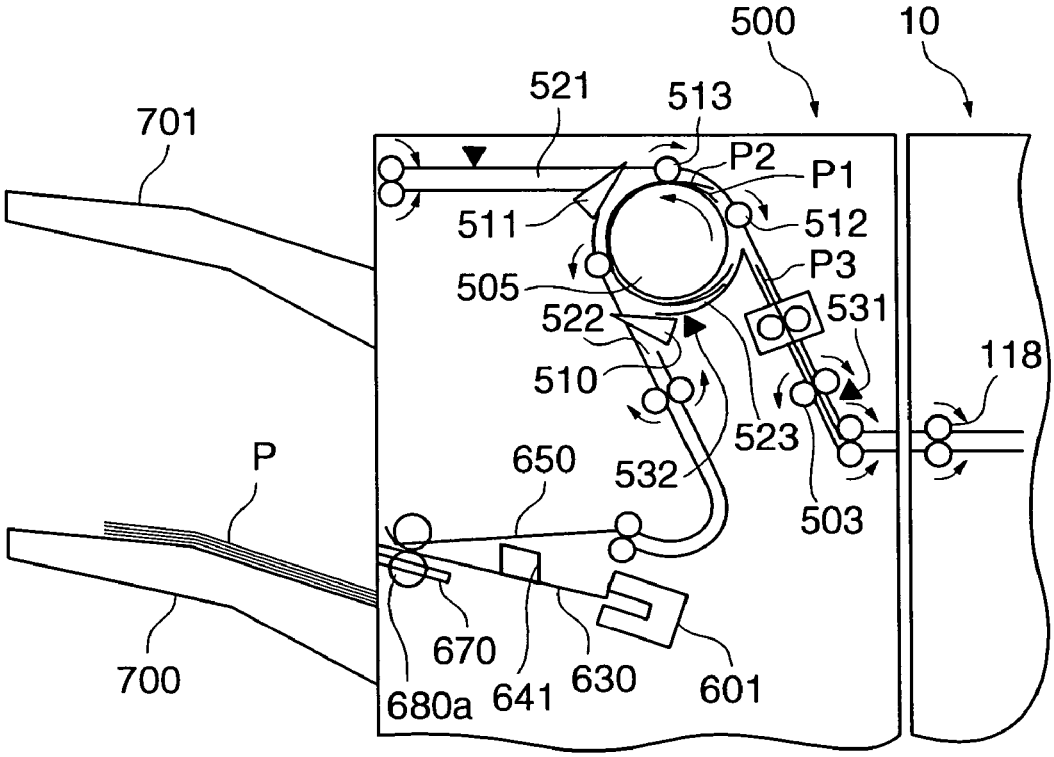
FIG. 21 is a view useful in explaining sheet conveyance in a sorting operation for a second bundle in the case where three sheets are superimposed one upon another.
Figure 22:
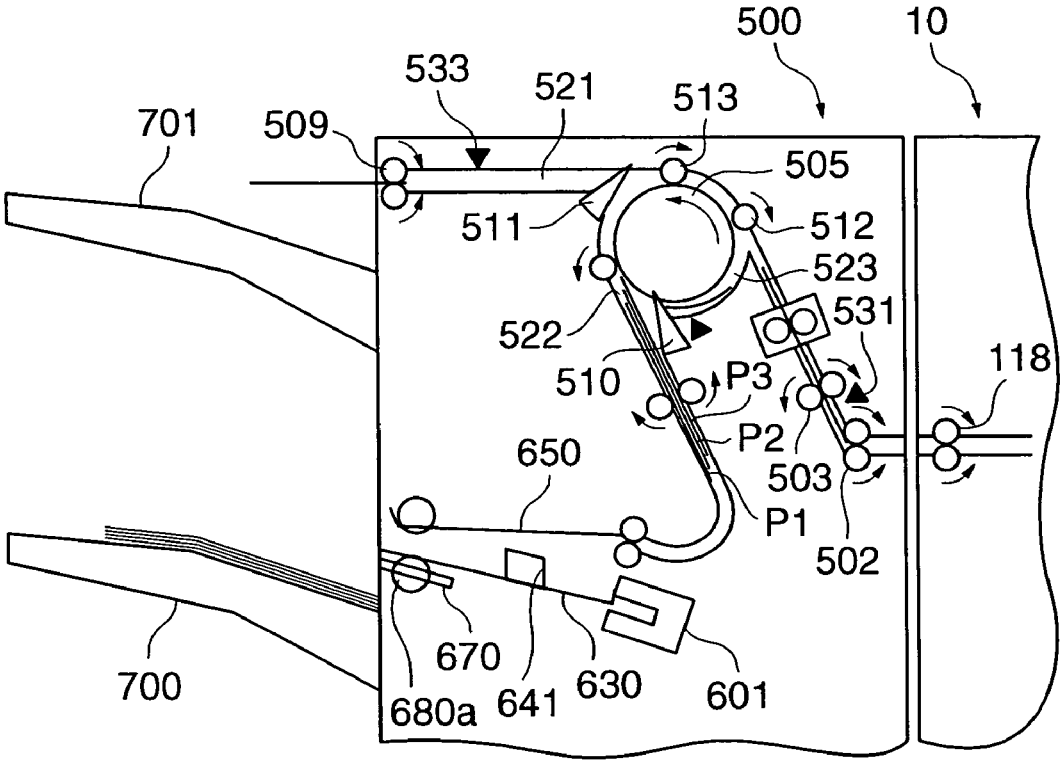
FIG. 22 is a view useful in explaining the sheet conveyance in the sorting operation for the second bundle in the case where three sheets are superimposed one upon another.

FIGS. 21 and 22 are views useful in explaining sheet conveyance during operation of sorting the second sheet bundle in the case where three sheets are superimposed. The sheet P2 is wound around the buffer roller 505 in a state superimposed on the sheet P1, and conveyed into the buffer path 523 in the state wound around the buffer roller 505. Then, the buffer roller 505 is stopped again when the sheet P2 is conveyed by a predetermined distance from the buffer path sensor 532 (see FIG. 21).

Then, when the leading edge of a sheet P3 as a third page is advanced from the inlet sensor 531 by a predetermined distance, the buffer roller 505 starts to be rotated again, whereby the sheet P3 is superimposed on the sheet P2 in a manner offset from the sheet P2 such that the sheet P3 is advanced from the sheet P2 by a predetermined distance. The sheets P1, P2 and P3 wound around the buffer roller 505 are peeled off the buffer roller 505 by the switching flapper 510 and conveyed as a three-sheet bundle P into the sorting path 522 (see FIG. 22).

Figure 23A:
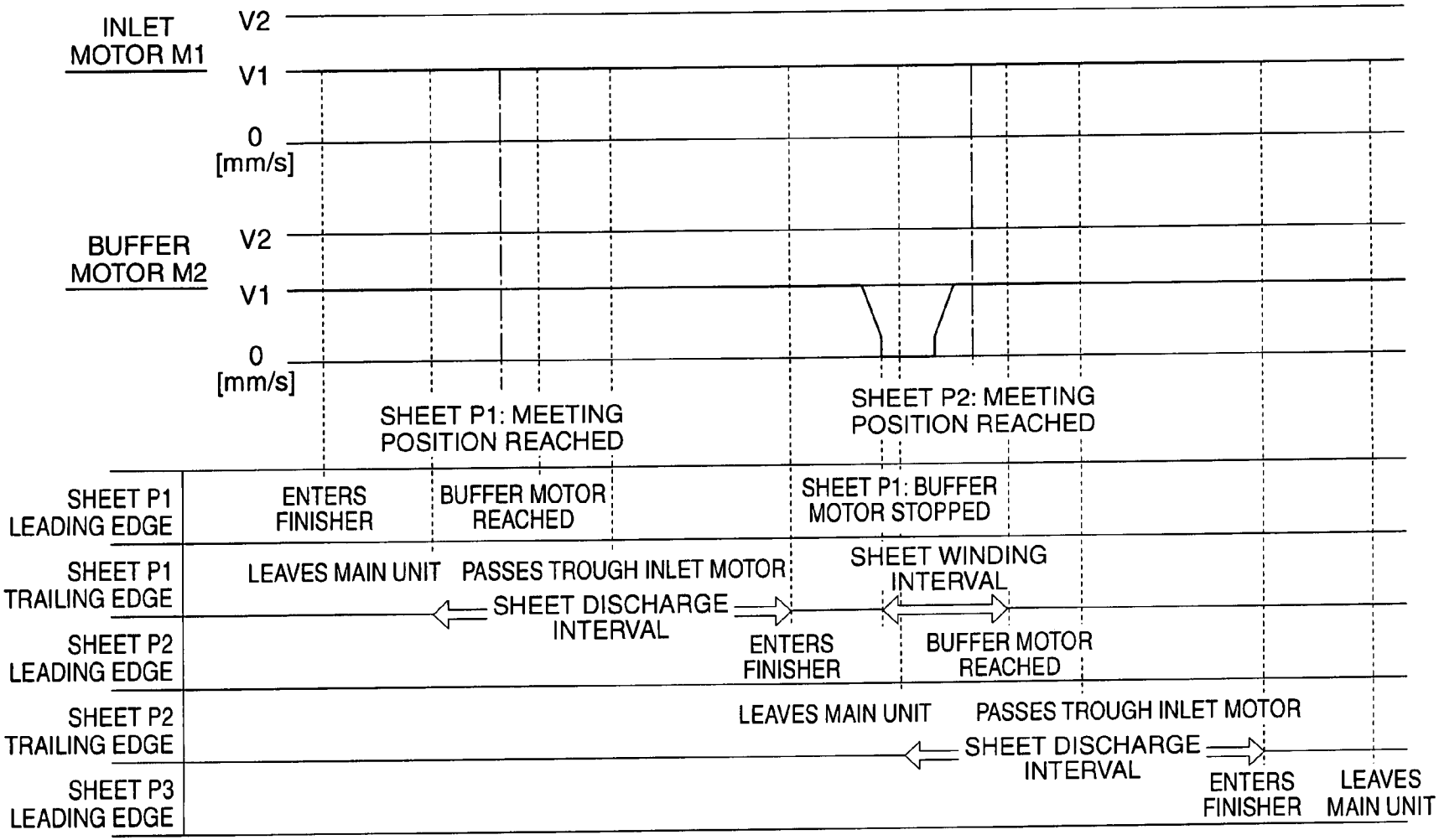
FIGS. 23A and 23B are timing charts useful in explaining two modes of motor speed control executed for a winding operation by a buffer roller.
Figure 23B:
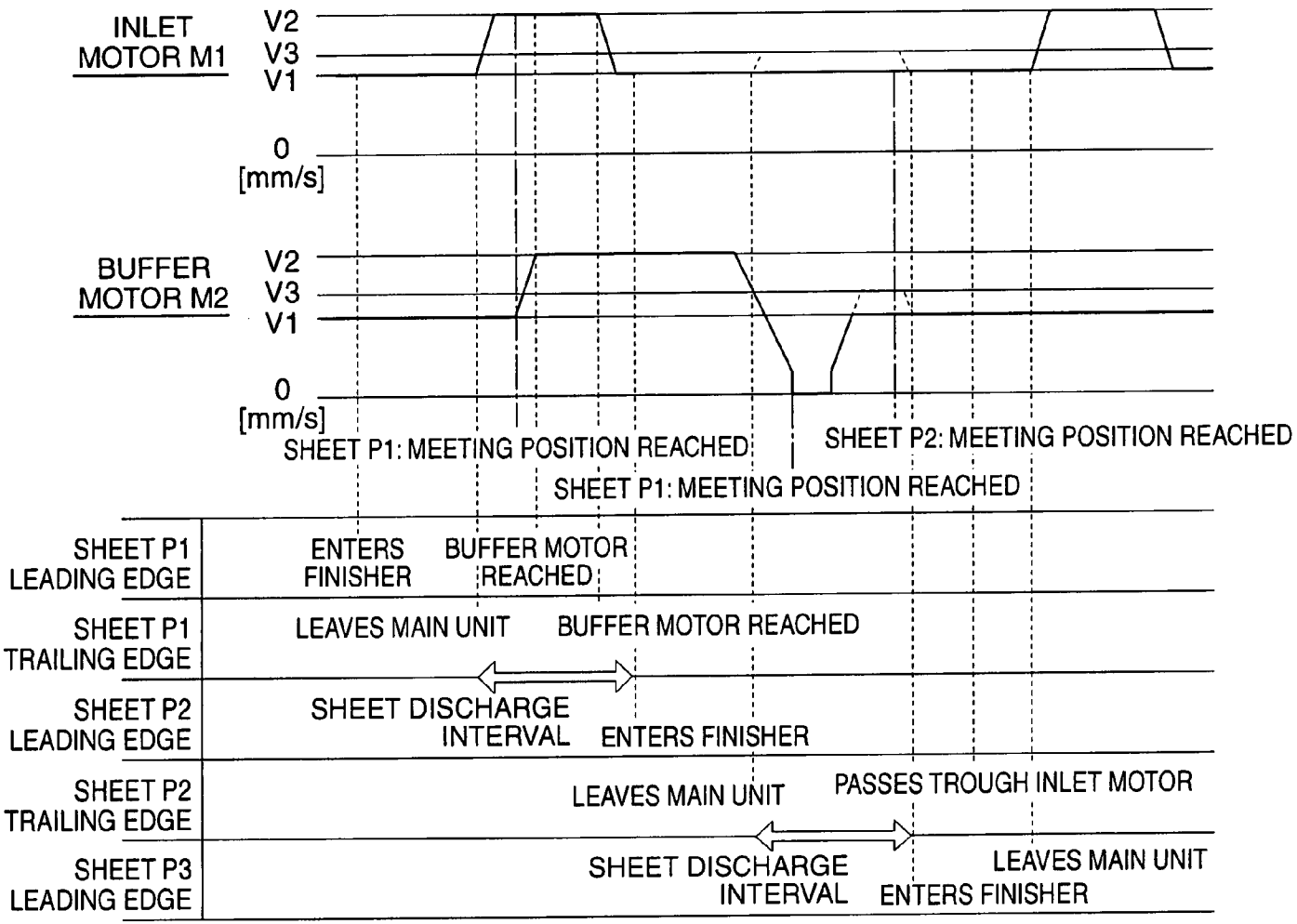

In the present embodiment, there are provided two modes, i.e. a normal mode and a small sheet interval mode, for carrying out an operation of winding sheets around the buffer roller 505. In the following, a description will be given of a motor speed control pattern in each of the modes. FIGS. 23A and 23B are timing charts useful in explaining the two modes of the motor speed control executed for the winding operation by the buffer roller 505. In these figures, the position of a sheet described as "buffer motor reached" corresponds to the position of the sheet having reached the location of the pressing roller 512 (i.e. the position indicated by a symbol A in FIG. 17). The position of a sheet described as "sheet meeting position reached" corresponds to the position of the sheet having reached a location (indicated by a symbol B in FIG. 17) where a sheet wound around the buffer roller 505 and a sheet discharged from the image forming apparatus main unit 10 meet each other.

FIG. 23A illustrates the normal mode of the motor speed control. When the sheet P1 for the first page of the second bundle is discharged from the image forming apparatus main unit 10, the inlet roller pair 502 and the conveying roller pair 503 are driven by the inlet motor M1 at the same speed as a discharge speed V1 of the image forming apparatus main unit 10 so as to ensure smooth sheet passage between the image forming apparatus main unit 10 and the finisher 500. The sheet P1 is then conveyed by the buffer roller 505, which is driven by the buffer motor M2 at the conveying speed V1, and the pressing rollers 512, 513, and 514, to be guided into the buffer path 523. When the sheet P1 is conveyed by a predetermined distance after the leading edge of the sheet P1 is detected by the buffer path sensor 532, the driving of the buffer motor M2 is stopped to stop conveyance of the sheet P1.

Then, at a time point the leading edge of the sheet P2 discharged from the image forming apparatus main unit 10 reaches a predetermined position in the finisher 500 (i.e. when the sheet P2 is conveyed by 50 mm after having been detected by the inlet sensor 531), the buffer motor M2 is started, and the conveying speed of the buffer roller 505 driven by the buffer motor M2 is increased to the conveying speed V1. As a result, the sheets P1 and P2 superimposed one upon the other are guided into the sorting path 522 by being conveyed at the constant speed. When three or more sheets are superimposed, the superimposing operation is performed under the same motor speed control, followed by the sheets being guided into the sorting path 522.

FIG. 23B shows the small sheet interval mode of the motor speed control. When the sheet P1 for the first page of the second bundle is discharged from the image forming apparatus main unit 10, the inlet roller pair 502 and the conveying roller pair 503 are driven by the inlet motor M1 at the same speed as the discharge speed V1 of the image forming apparatus main unit 10 so as to ensure smooth sheet passage between the image forming apparatus main unit 10 and the finisher 500. It should be noted that the small sheet interval mode may be set by a service man when the image forming apparatus main unit 10 with the discharge speed thereof being faster than a predetermined speed and the finisher 500 are installed, or may be set according to an instruction from the image forming apparatus main unit 10 depending upon an image forming mode then selected.

When the trailing end of the sheet P1 leaves the image forming apparatus main unit 10, the inlet motor M1 is accelerated to a conveying speed V2 which is faster than the discharge speed V1 of the image forming apparatus main unit 10. This makes it possible to increase the space interval between the sheet P1 and the succeeding sheet P2. In doing this, if the trailing end of the final sheet for the first sheet bundle has passed between the buffer roller 505 and the pressing roller 514, the conveying speed of the buffer roller 505, which is driven by the buffer motor M2, and the pressing roller 512 is increased simultaneously. On the other hand, if the trailing end of the final sheet for the first sheet bundle has not passed between the buffer roller 505 and the pressing roller 514, the buffer motor M2 is accelerated to the conveying speed V2 after the first sheet bundle has passed between the buffer roller 505 and the pressing roller 514.

Thereafter, the sheet P1 is conveyed at the conveying speed V2 by the buffer roller 505 and the pressing rollers 512, 513 and 514 to be guided into the buffer path 523. When the sheet P1 is conveyed by a predetermined distance after the leading edge of the sheet P1 is detected by the buffer path sensor 532, the driving of the buffer motor M2 is stopped to stop conveyance of the sheet P1. In the meantime, when the trailing end of the sheet P1 has passed through the conveying roller pair 503 driven by the inlet motor M1, the inlet motor M1 is decelerated to the conveying speed V1 at which the following sheet P2 is to be discharged from the image forming apparatus main unit 10.

Then, at a time point the leading edge of the sheet P2 discharged from the image forming apparatus main unit 10 reaches a predetermined position in the finisher 500, the buffer motor M2 is started, and the conveying speed of the buffer roller 505 driven by the buffer motor M2 is increased to the conveying speed V1. As a result, the sheets P1 and P2 superimposed one upon the other are guided into the sorting path 522 by being conveyed at the constant speed.

The sheet P2 is guided into the sorting path 522 after being superimposed on the sheet P1, and hence, differently from the case of conveying the sheet P1, when the trailing end of the sheet P2 leaves the image forming apparatus main unit 10, the inlet motor M1 is not accelerated to the conveying speed V2. This is because if the conveying speed of the sheet P2 were increased to the conveying speed V2, the space interval between the sheet P2 and the final sheet for the first sheet bundle would be reduced.

However, when a time period between discharge of the final sheet for the first sheet bundle onto the processing tray 630 and discharge of the sheet bundle of the sheets P1 and P2 superimposed one upon the other onto the processing tray 630 is longer than a time period needed for post-processing, such as the aligning processing and the stapling process, executed on the processing tray 630, the inlet motor M1 may be accelerated to a conveying speed V3 which is higher than the conveying speed V1 and lower than the conveying speed V2 so as to convey the sheet P2 at the accelerated speed V3.

Although the present embodiment relates to the conveyance control executed in the case where two sheets are superimposed, similar conveyance control may be executed in the case where three or more sheets are superimposed. In this case, the conveying speed for the final one of the sheets to be superimposed is not increased to prevent reduction of the space interval between the final one of the superimposed sheets and the final sheet for the first bundle sheet, but the other sheets preceding the final one are conveyed at an increased conveying speed, whereby the sheet superimposing operation is carried out with an increased inter-sheet distance. The motor speed control is performed in parallel with a sorted sheet sequence process, described in detail hereinafter, which is executed by the CPU 550.

Figure 24:
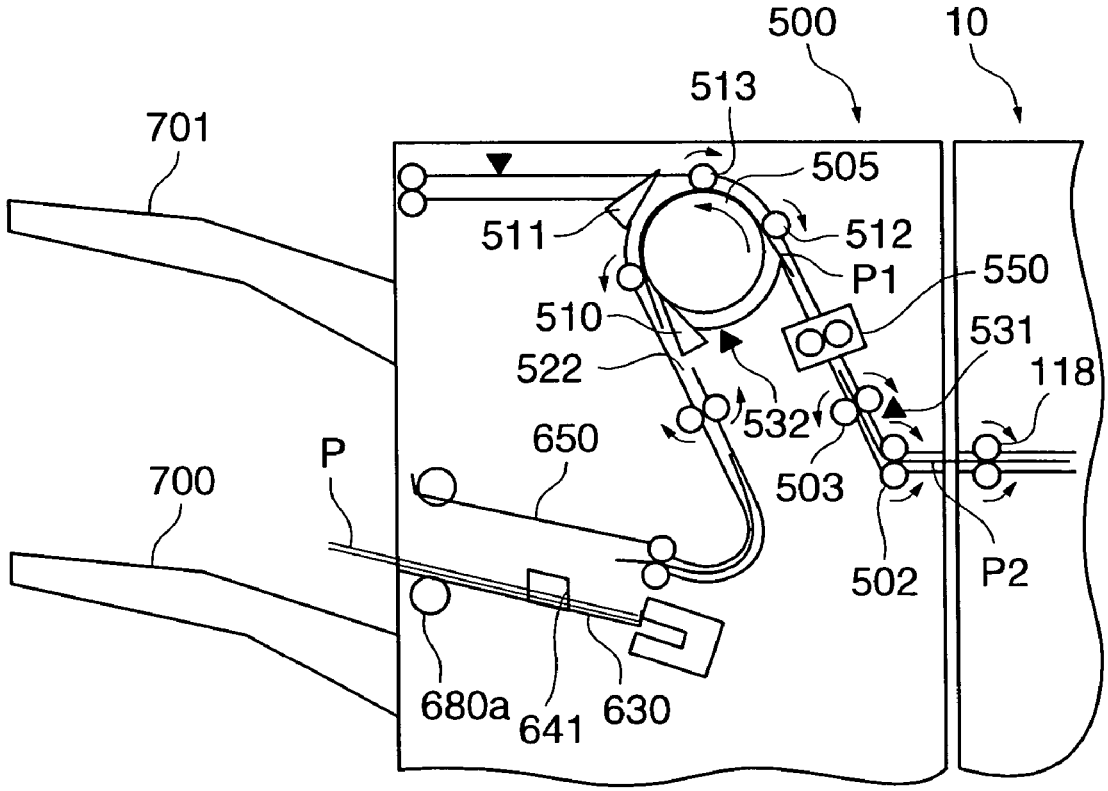
FIG. 24 is a view useful in explaining sheet conveyance in a sorting mode.
Figure 25:
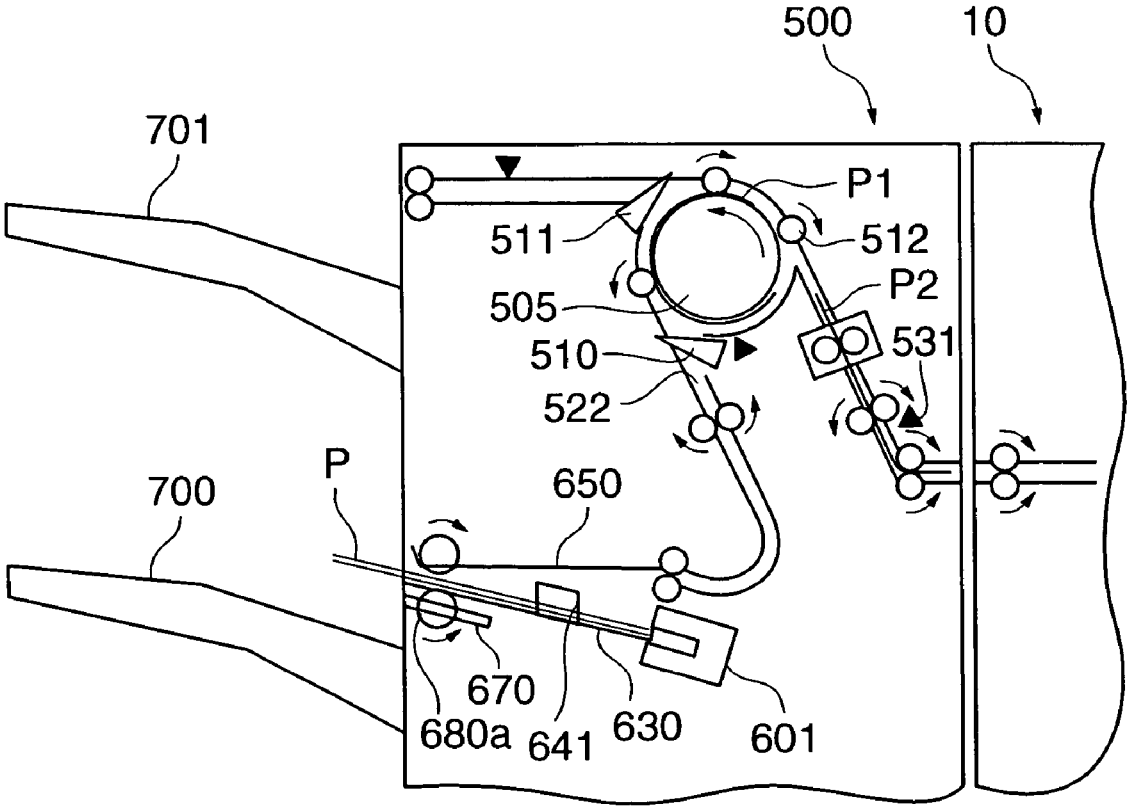
FIG. 25 is a view useful in explaining the sheet conveyance in the sorting mode.

FIGS. 24 and 25 are views useful in explaining sheet conveyance in the sorting mode. When the sorting mode is set, the inlet roller pair 502 and the conveying roller pair 503 are driven for rotation, as in the case of the stapling sorting mode, whereby sheets discharged from the image forming apparatus main unit 10 are sequentially stacked onto the processing tray 630 (see FIG. 24). Thereafter, a bundle discharge operation described hereinbefore is carried out to discharge a sheet bundle P onto the stack tray 700.

In the meantime, a sheet P1 discharged from the image forming apparatus main unit 10 is wound around the buffer roller 505 by the operation of the switching flapper 510, and the buffer roller 505 is stopped when the sheet P1 is advanced by a predetermined distance from the buffer path sensor 532 (see FIG. 25). Then, when the leading edge of a succeeding sheet P2 is advanced from the inlet sensor 531 by a predetermined distance, the buffer roller 505 starts to be rotated, whereby the succeeding sheet P2 is superimposed on the sheet P1 such that it is advanced from the sheet P1 by a predetermined distance.

The conveying operation is thus carried out, in the same manner as in the stapling sorting mode described above, and a predetermined number of sheet bundles are stacked on the stack tray 700 in a manner alternately offset from each other. The sheet bundles are stacked one upon another in such a manner that the leading page of each sheet bundle is placed at the bottom of the sheet bundle, with its image-formed surface facing downward and the following pages sequentially stacked on the leading page in page order.

Next, a description will be given of the bundle discharge operation of the sheet processing apparatus (finisher) configured as above. The finisher control section 501 provides control to carry out sheet conveyance in each of the non-sorting mode, the stapling sorting mode, and the sorting mode. In the finisher control section 501, processing depending on a designated mode is carried out by related parts of the section 501 according to instructions from the CPU circuit section 150.

Figure 26:
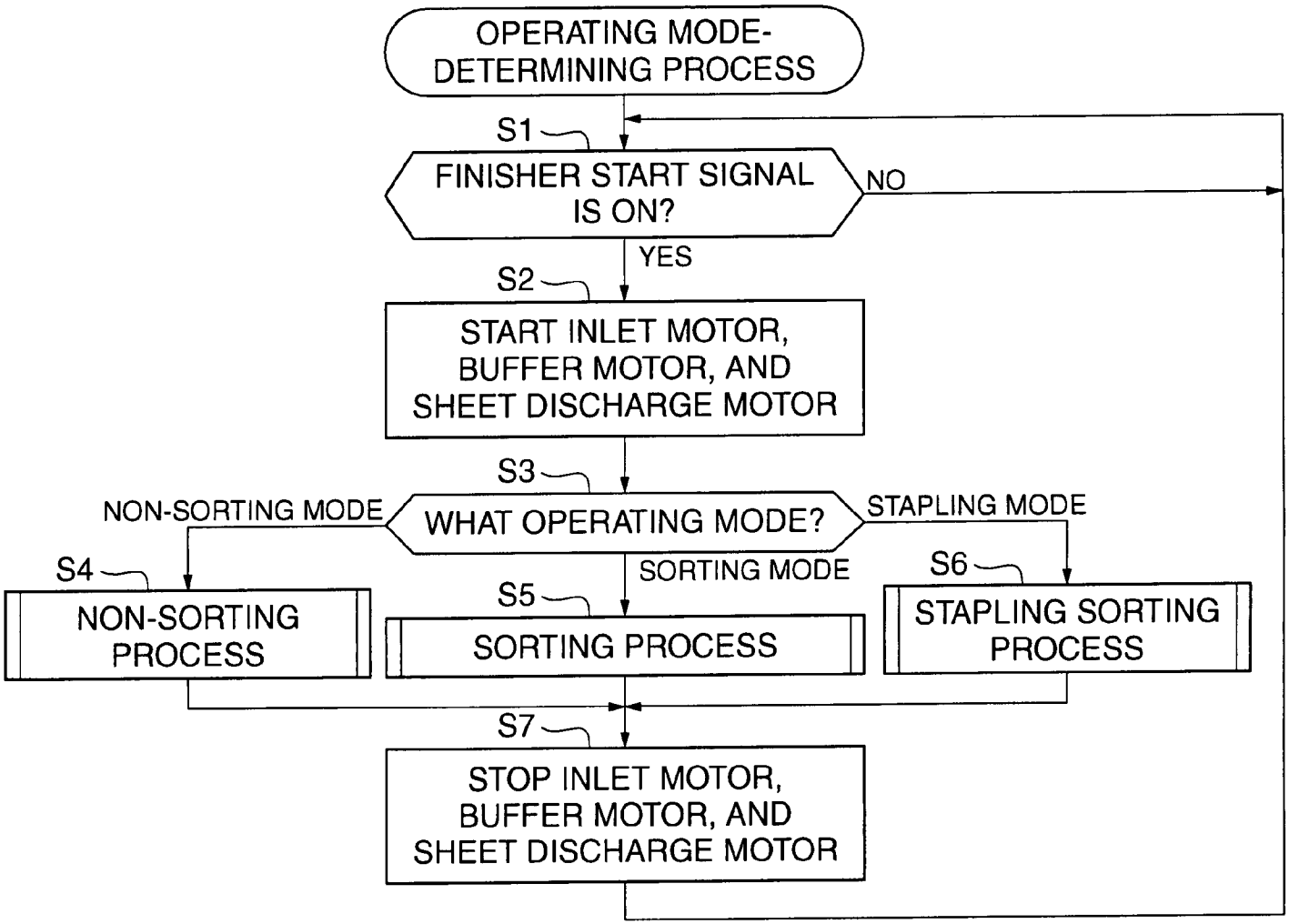
FIG. 26 is a flowchart showing an operation mode-determining process.

FIG. 26 is a flowchart of an operation mode-determining process. A program for executing the operation mode-determining process is stored in the ROM 551 of the finisher control section 501 and executed by the CPU 550. First, turn-on of a finisher start signal is awaited (step S1). The finisher start signal is turned on when the start key 402 is depressed which is provided on the operating/display unit 400 of the image forming apparatus main unit 10, for starting copying, and then a signal for starting a finisher operation is input from the image forming apparatus main unit 10 to the CPU 550 of the finisher control section 501 via the communication IC. When the finisher start signal is turned on, the CPU 550 starts driving the inlet motor M1, the buffer motor M2, the sheet discharge motor M3, and so forth (step S2). On the other hand, when the finisher start signal is not turned on, the finisher 500 enters a standby state.

Then, the operating mode that is set is determined (step S3). If the set operating mode is the non-sorting mode, the non-sorting process is executed (step S4). If the set operating mode is the sorting mode, the sorting process is executed (step S5). Further, if the set operating mode is the stapling sorting mode, a stapling sorting process is executed (step S6). The non-sorting process, the sorting process, and the stapling sorting process will be described in detail hereinafter.

When the process in the determined set mode, i.e. the process in a corresponding one of the steps S4 to S6 is completed, the driving of the inlet motor M1, the buffer motor M2, the sheet discharge motor M3, and so forth is stopped (step S7). Then, the process returns to the step S1, wherein the finisher 500 enters the standby state.

Figure 27:
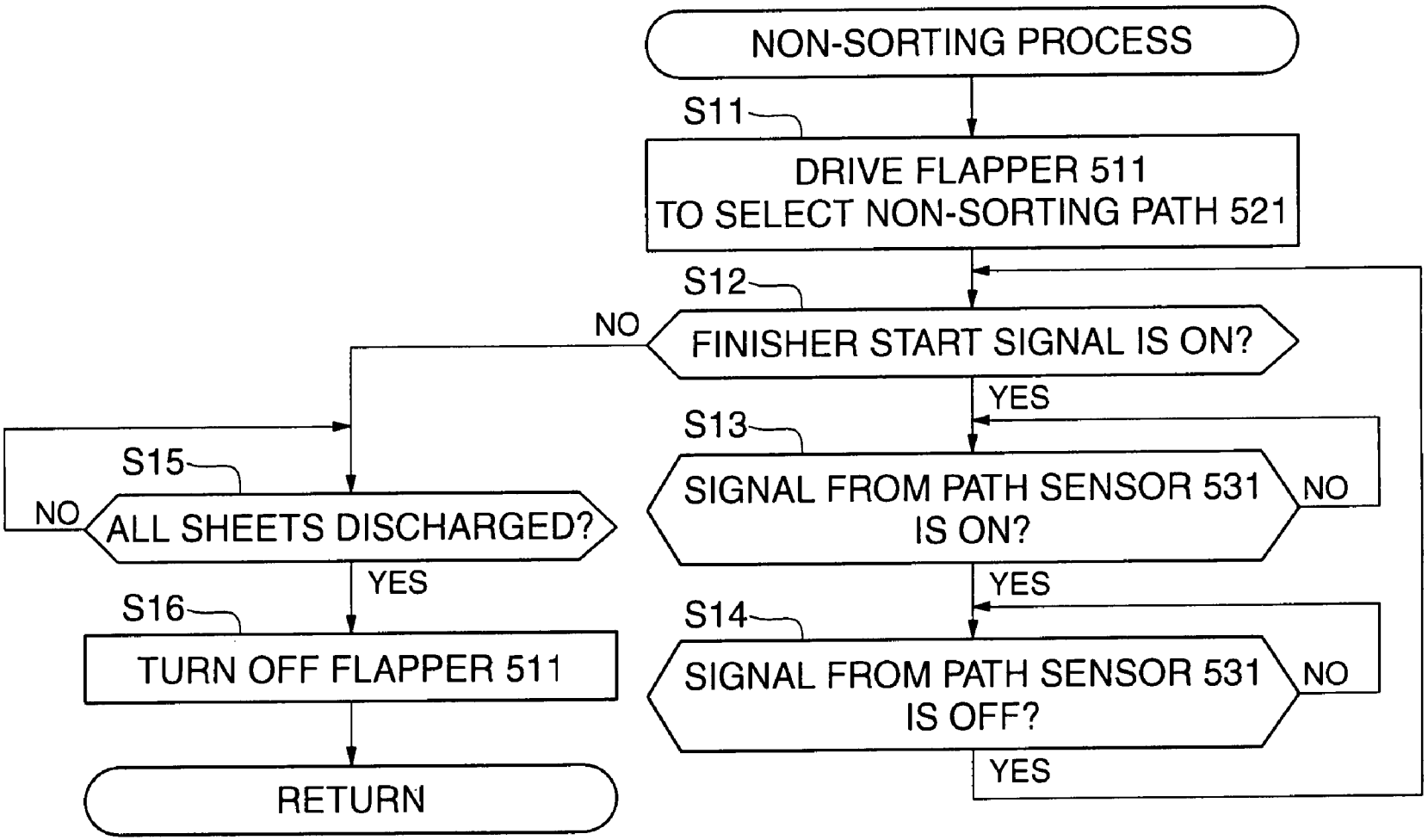
FIG. 27 is a flowchart showing a non-sorting process.

FIG. 27 is a flowchart of the non-sorting process executed in the step S4 in FIG. 26. In the non-sorting process, a sheet P is guided onto the sample tray 701, and therefore the flapper 511 is driven to select the non-sorting path 521 as a path into which the sheet P is to be conveyed (step S11). Then, it is determined whether or not the finisher start signal is on (step S12). If the finisher start signal is on, the sheet P discharged from the image forming apparatus main unit 10 is guided into a sheet path through the finisher 500.

When the sheet P guided into the sheet path is conveyed via the inlet roller pair 502 driven by the inlet motor M1., turn-on of a signal from the inlet (path) sensor 531 in response to detection of the leading edge of the sheet P thereby is awaited (step S13). When the signal from the path sensor 531 is turned on, turn-off of the signal from the path sensor 531 in response to leaving of the trailing end of the conveyed sheet P therefrom is awaited (step S14). When the signal from the path sensor 531 is turned off, the process returns to the step S12. If it is determined again in the step S12 that the finisher start signal is on, the steps S13 and S14 are repeatedly executed.

On the other hand, when the finisher start signal is turned off, discharge of all sheets onto the sample tray 701 is awaited (step S15). Then, when the discharge of all the sheets is completed, the switching operation of the flapper 511 is cancelled (step S16) to terminate the non-sorting process, followed by the process returning to the main process.

Figure 28:
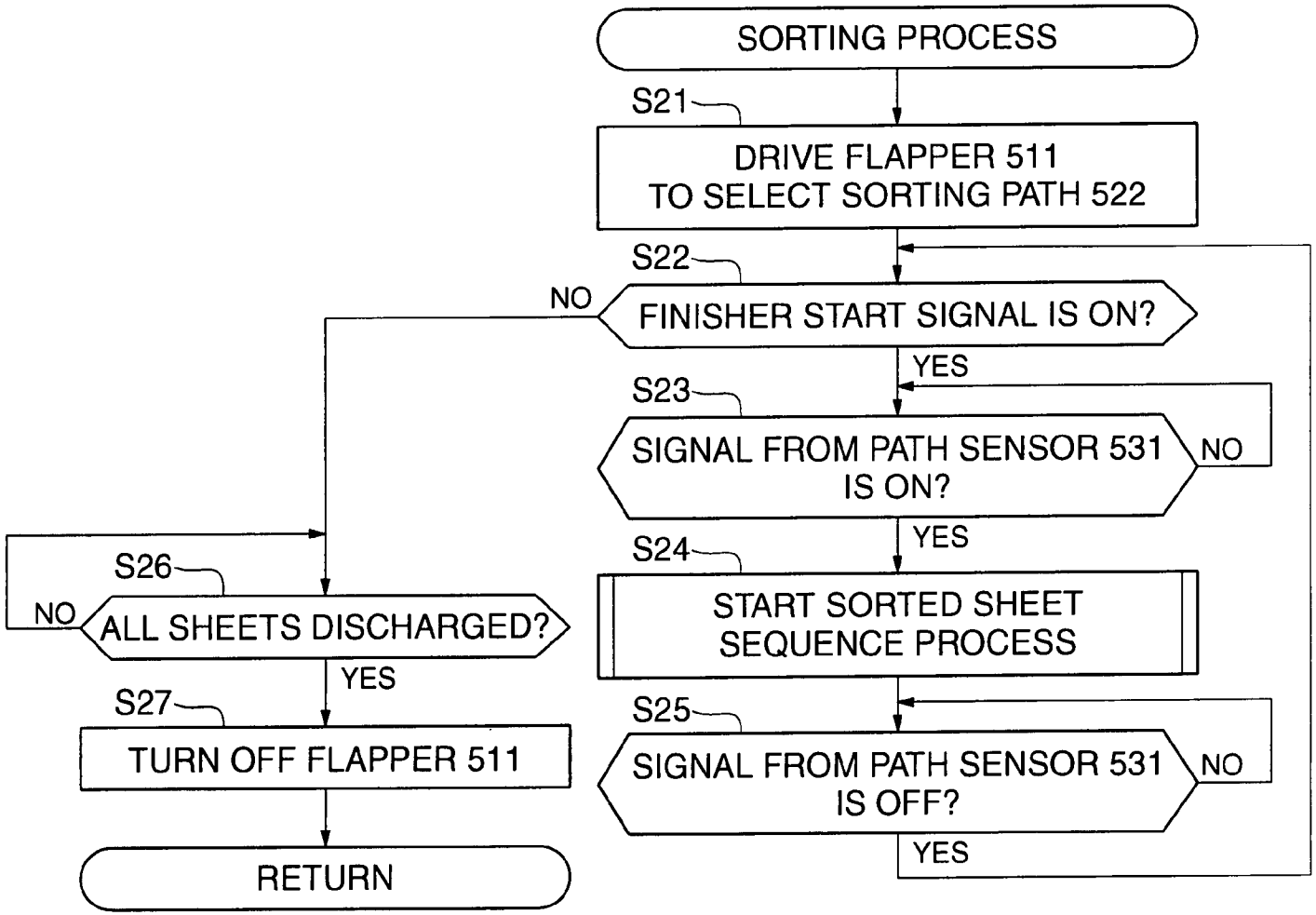
FIG. 28 is a flowchart showing a sorting process.

FIG. 28 is a flowchart of the sorting process executed in the step S5 in FIG. 26. In the sorting process, the sheet P is guided onto the processing tray 630, and therefore the flapper 511 is driven to select the sorting path 522 as a path into which the sheet P is to be conveyed (step S21). Then, it is determined whether or not the finisher start signal is on (step S22). If the finisher start signal is on, the sheet P discharged from the image forming apparatus main unit 10 is guided into a sheet path through the finisher 500. When the sheet P guided into the sheet path is conveyed via the inlet roller pair 502 driven by the inlet motor M1, turn-on of the signal from the path sensor 531 in response to detection of the leading edge of the sheet P thereby is awaited (step S23).

When the signal from the path sensor 531 is turned on, the sorted sheet sequence process is started (step S24), and turn-off of the signal from the path sensor 531 in response to leaving of the trailing end of the conveyed sheet P therefrom is awaited (step S25). When the signal from the path sensor 531 is turned off, the process returns to the step S22. If it is determined again in the step S22 that the finisher start signal is on, the steps S23, S24, and S25 are repeatedly executed. On the other hand, when the finisher start signal is turned off, discharge of all the sheets onto the processing tray 630 is awaited (step S26). Then, when the discharge of all the sheets is completed, the switching operation of the flapper 511 is cancelled (step S27) to terminate the sorting process, followed by the process returning to the main process.

Figure 29:
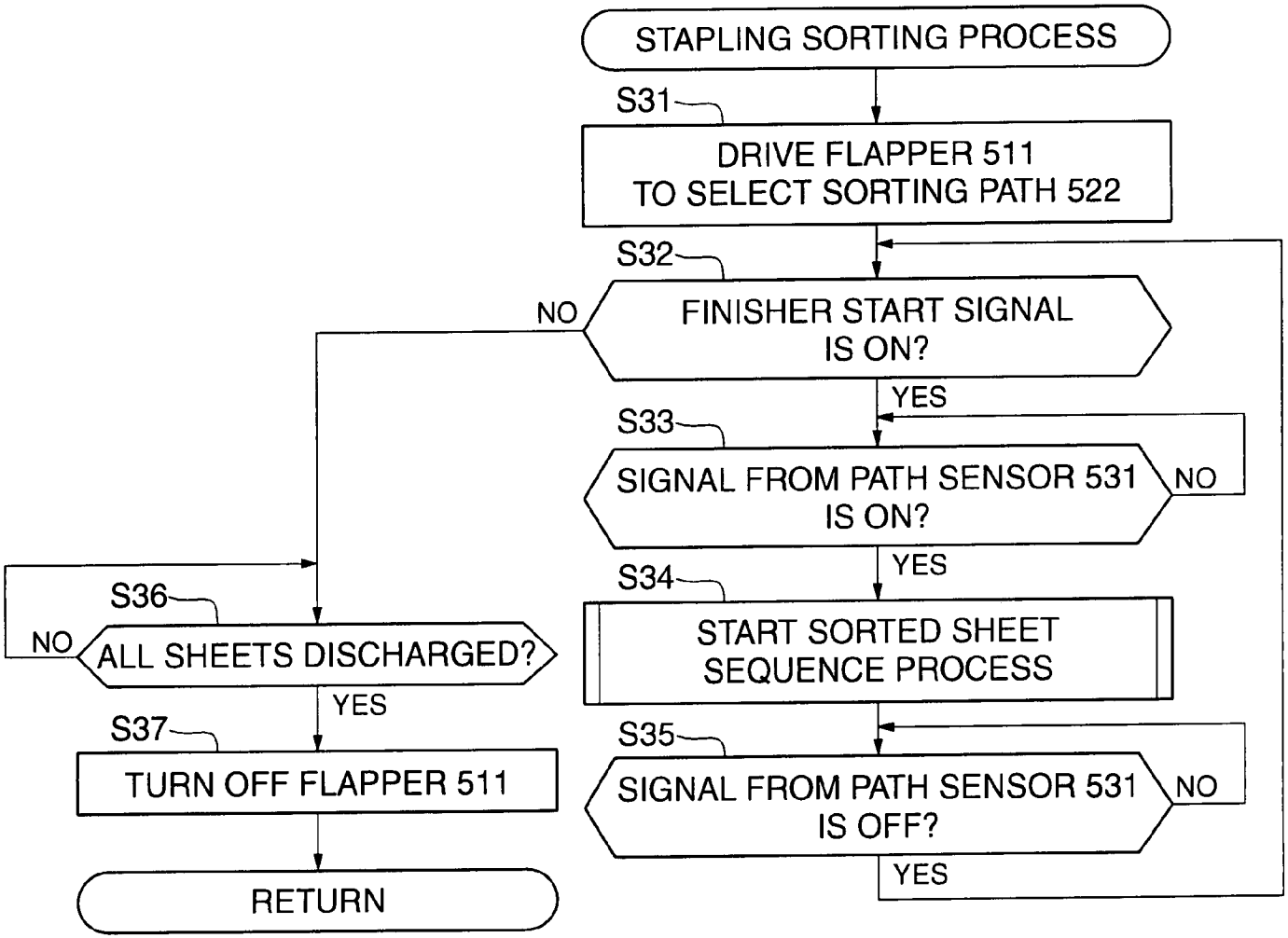
FIG. 29 is a flowchart showing a stapling sorting process.

FIG. 29 is a flowchart of the stapling sorting process executed in the step S6 in FIG. 26. In the stapling sorting process, the sheet P is guided into the processing tray 630, and therefore, first, the flapper 511 is driven to select the sorting path 522 as a path into which the sheet P is to be conveyed (step S31).

Then, it is determined whether or not the finisher start signal is on (step S32). If the finisher start signal is on, the sheet P discharged from the image forming apparatus main unit 10 is guided into the sheet path in the finisher 500. When the sheet P guided into the sheet path is conveyed via the inlet roller pair 502 driven by the inlet motor M1, turn-on of the signal from the path sensor 531 in response to detection of the leading edge of the sheet P thereby is awaited (step S33). Then, when the signal from the path sensor 531 is turned on, the sorted sheet sequence process is started (step S34).

Further, turn-off of the signal from the path sensor 531 in response to leaving of the trailing end of the conveyed sheet P therefrom is awaited (step S35). When the signal from the path sensor 531 is turned off, the process returns to the step S32. If it is determined again in the step S32 that the finisher start signal is on, the steps S33, S34, and S35 are repeatedly executed. On the other hand, when the finisher start signal is turned off, discharge of all the sheets onto the processing tray 630 is awaited (step S36). Then, when the discharge of all the sheets is completed, the switching operation of the flapper 511 is cancelled (step S37), followed by terminating the stapling sorting process.

Figure 30A:
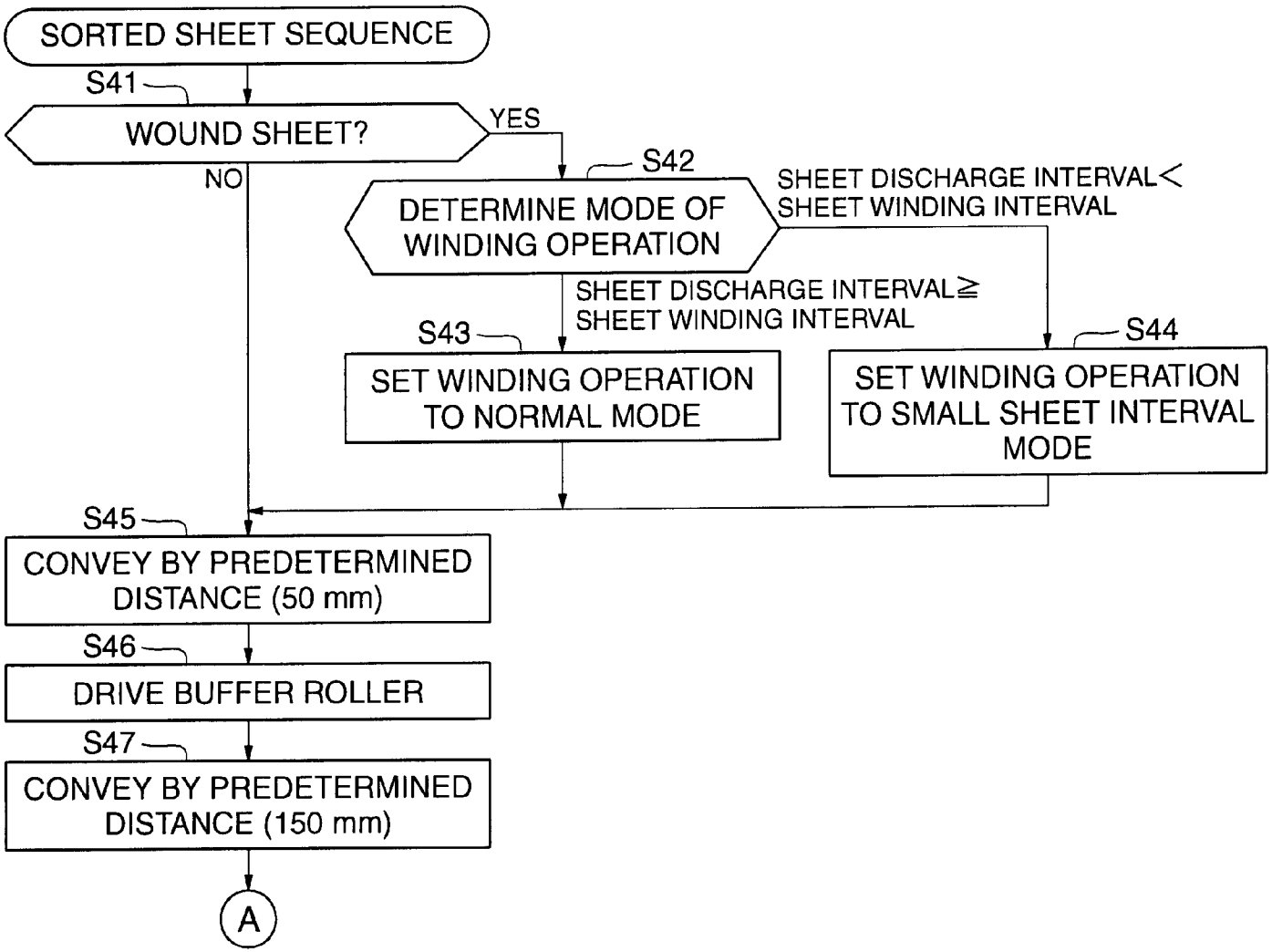
FIGS. 30A and 30B are flowchart showing a sorted paper sequence process.
Figure 30B:
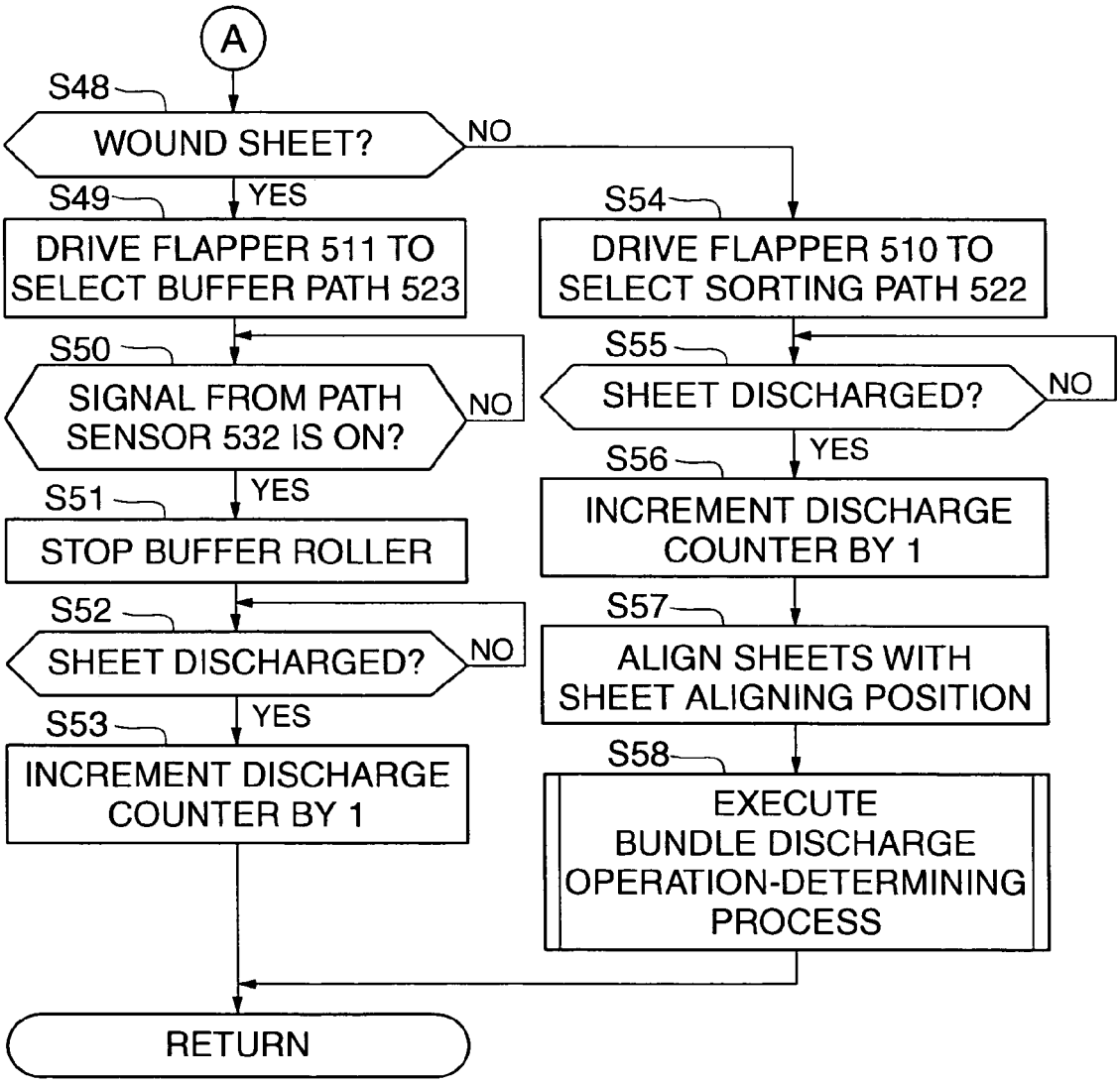

FIGS. 30A and 30B are flowchart of the sorted sheet sequence process executed in the step S24 in FIG. 28 and the step S34 in FIG. 29. The sorted sheet sequence process is carried out on each conveyed sheet, and a program for executing this process is stored in the ROM 551 and executed by the CPU 550 by multi-task processing (parallel processing).

First, it is determined whether or not a sheet to be conveyed is a sheet to be wound around the buffer roller 505 (hereinafter referred to as "the wound sheet") (step S41). If the sheet is designated as the wound sheet, it is determined whether the conveyance control mode for carrying out a winding operation is set to the normal mode or the small sheet interval mode (step S42). This determination is carried out by comparing a time interval (sheet discharge interval) between discharge of a preceding sheet discharged from the image forming apparatus main unit 10 into the finisher 500 and discharge of a following sheet discharged from the same, with a time interval (sheet winding interval) required for conveying the preceding sheet on standby at a predetermined position on the buffer path 523 to the sheet meeting position and superimposing the preceding sheet and the following sheet assuming that the winding operation is carried out at a conveying speed at which each sheet discharged from the image forming apparatus main unit 10 into the finisher 500 is conveyed. When the sheet discharge interval is longer than the sheet winding interval, the conveyance control mode is set to the normal mode (step S43).

On the other hand, when the sheet winding interval is longer than the sheet discharge interval, the conveyance control mode is set to the small sheet interval mode (step S44). Information on the sheet discharge interval has already been notified by the CPU circuit section 150 to the finisher control section 501 at a time point the preceding sheet was conveyed into the finisher 500. Thereafter, the process proceeds to a step S45.

If the sheet is not designated as the wound sheet in the step S41, the setting of the conveyance control mode is not executed. Then, when the sheet is conveyed from the path sensor 531 by a predetermined distance (50 mm in the present embodiment) (step S45), the buffer motor M2 is started to drive the buffer roller 505 (step S46). At this time, the sorted sheet sequence process is started in response to turn-on of the signal from the path sensor 531, so that the buffer motor M2 is started when the leading edge of the sheet is advanced 50 mm downstream of a position where it was when the signal from the path sensor 531 was turned on. The start of the buffer motor M2 is intended to further convey the sheet and to restart the "wound sheet" which is in stoppage in a state wound around the buffer roller 505. By starting the buffer motor M2 in this timing, the sheet in the state superimposed on the wound sheet can be conveyed together therewith.

It should be noted that although in the present embodiment, as a condition for defining the timing in which the buffer motor M2 is started, the distance over which the leading edge of the sheet is advanced downstream of the position where it was when the signal from the path sensor 531 was turned on is set to 50 mm, the distance can be set to another value as desired.

Then, the sheet is conveyed by a predetermined distance (150 mm in the present embodiment) (step S47), and it is determined whether or not the sheet is a wound sheet (step S48). If the sheet has been designated as a wound sheet, the flapper 510 is driven to select the buffer path 523 as a path into which the sheet is to be conveyed (step S49). Sheet conveyance is continued in this state, whereby the sheet can be guided into the buffer path 523 for winding the sheet around the buffer roller 505.

Then, turn-on of the signal from the path sensor 532 disposed in the buffer path 523 is awaited (step S50), and when the signal from the path sensor 532 is turned on, stop control for stopping the buffer motor M2 is started to wind the sheet around the buffer roller 505 (step S51). When the leading edge of the sheet passes by the path sensor 532, winding control for stopping the buffer roller 505 is carried out. In this case, the buffer roller 505 is stopped with an overrun amount of the buffer roller 505 taken into consideration.

After the buffer roller 505 is stopped, the sheet wound around the buffer roller 505 is placed on standby as it is until the buffer roller 505 is restarted for another succeeding sheet. Then, after restart of the buffer roller 505, completion of discharge of the sheet onto the processing tray 630 is awaited (step S52), and upon completion of the discharge, the count of a discharge counter indicative of the number of sheets discharged onto the processing tray 630 is incremented by one (step S53), followed by terminating the present process to return to the main process.

On the other hand, if it is determined in the step S48 that the sheet is not a wound sheet, the flapper 510 is driven to select the sorting path 522 as a path into which the sheet is to be conveyed (step S54). By driving the flapper 510, the sheet is guided not into the buffer path 523, but into the sorting path 522 as a discharge path leading to the processing tray 630. Then, completion of discharge of the sheet onto the processing tray 630 is awaited (step S55), and after completion of the discharge is confirmed, the count of the discharge counter is incremented by one (step S56). Thereafter, the sheet is aligned with a sheet aligning position set on a sheet-by-sheet basis, using the two aligning members 641 and 642 (step S57). In this step, the aligning operation for the sheet is performed in a direction approximately orthogonal to the sheet conveying direction upon discharge of the sheet onto the processing tray 630, and by turning the paddle, not shown, the sheet is also aligned in the sheet conveying direction. Thereafter, a bundle discharge operation-determining process, described in detail hereinafter, is executed (step S58), followed by terminating the present process to return to the main process.

Figure 31:
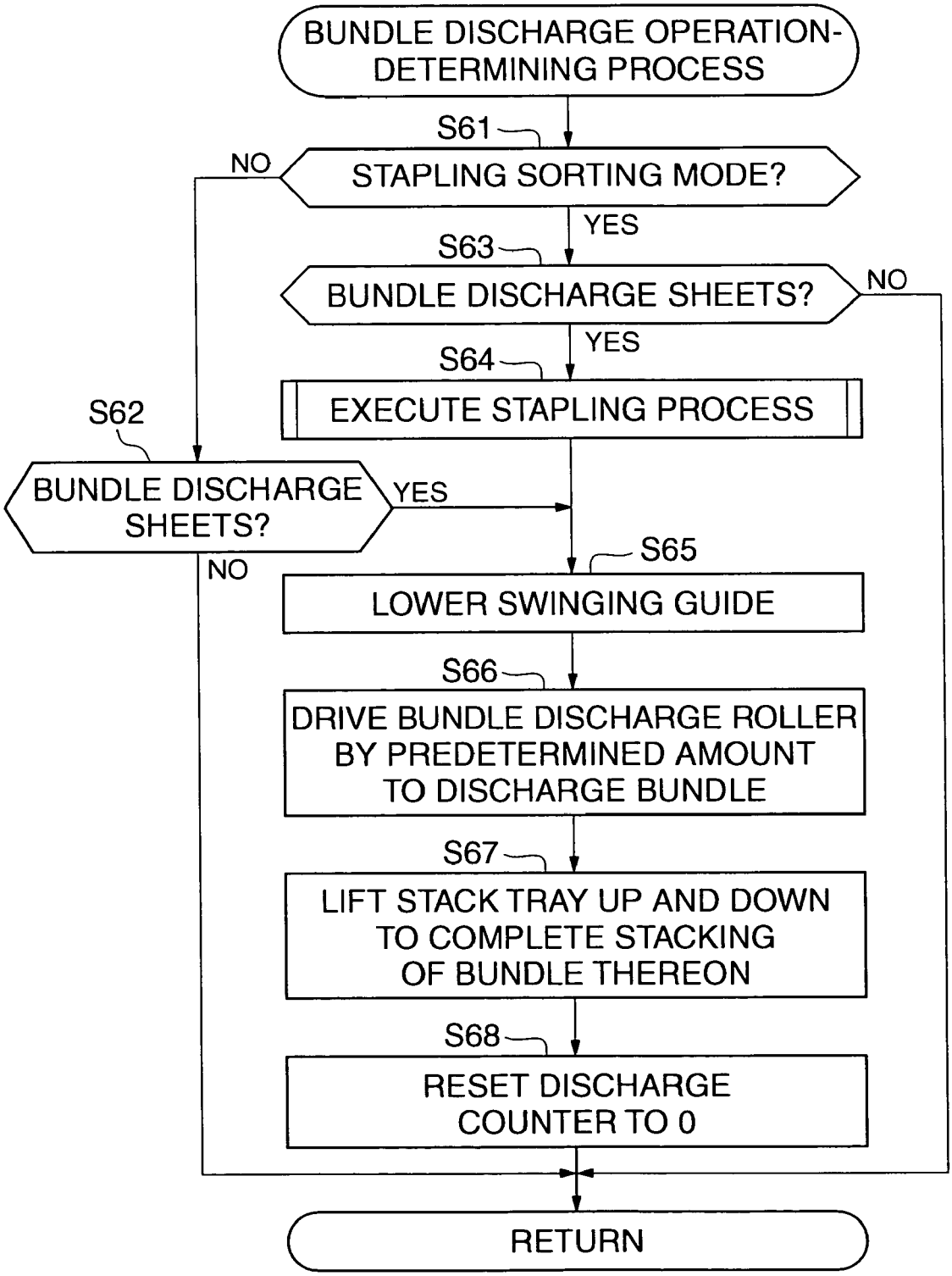
FIG. 31 is a flowchart showing a bundle discharge operation-determining process.

FIG. 31 is a flowchart of the bundle discharge operation-determining process executed in the step S58 in FIG. 30B. First, it is determined whether or not the operating mode is set to the stapling sorting mode (step S61). If it is determined that the operating mode is set to the stapling sorting mode, it is determined whether or not sheets discharged onto the processing tray 630 are to be discharged in a bundle (step S63). If the sheets are not to be discharged in a bundle, the present process is terminated to return to the sorted sheet sequence process as the higher-order process. On the other hand, if the sheets discharged onto the processing tray 630 are to be discharged in a bundle, the stapling process is executed (step S64). The stapling process will be described in detail hereinafter.

After completion of stapling process for the sheet bundle on the processing tray 630, the swinging guide 650 is lowered to bring the sheet discharge roller 680*b* into contact with the sheet bundle on the processing tray 630 (step S65).

Then, after the sheet discharge roller 680*b* stops bounding, the sheet discharge roller 680*b* is driven by a predetermined amount to discharge the sheet bundle from the processing tray 630 onto the stack tray 700 while controlling the speed of the bundle discharge motor M180 (step S66).

Then, the stack tray 700 is lifted up and down, whereby the operation of stacking the sheet bundle onto the stack tray 700 is completed (step S67). Thereafter, the count of the discharge counter is set to a value of 0 (step S68), followed by terminating the present process to return to the sorted sheet sequence process as the higher-order process.

On the other hand, if it is determined in the step S61 that the operating mode is not set to the stapling sorting mode, it is determined in a step S62 whether or not the sheets discharged onto the processing tray 630 are to be discharged in a bundle. If the sheets are not to be discharged in a bundle, the present process is terminated to return to the sorted sheet sequence process as the higher-order process.

On the other hand, if it is determined in the step S62 that the sheets discharged onto the processing tray 630 are to be discharged in a bundle, the swinging guide is operated in the step S65 to bring the sheet discharge roller 680*b* into contact with the sheet bundle on the processing tray 630. Then, after the sheet discharge roller 680*b* stops bounding, the sheet discharge roller 680*b* is driven by a predetermined amount in the step S66 to discharge the sheet bundle from the processing tray 630 onto the stack tray 700 while controlling the speed of the bundle discharge motor M180.

Then, the stack tray 700 is lifted up and down in the step S67, whereby the operation of stacking the sheet bundle onto the stack tray 700 is completed. Thereafter, the count of the discharge counter is set to the value of 0 in the step S68, followed by terminating the present process to return to the sorted sheet sequence process as the higher-order process.

Figure 32:
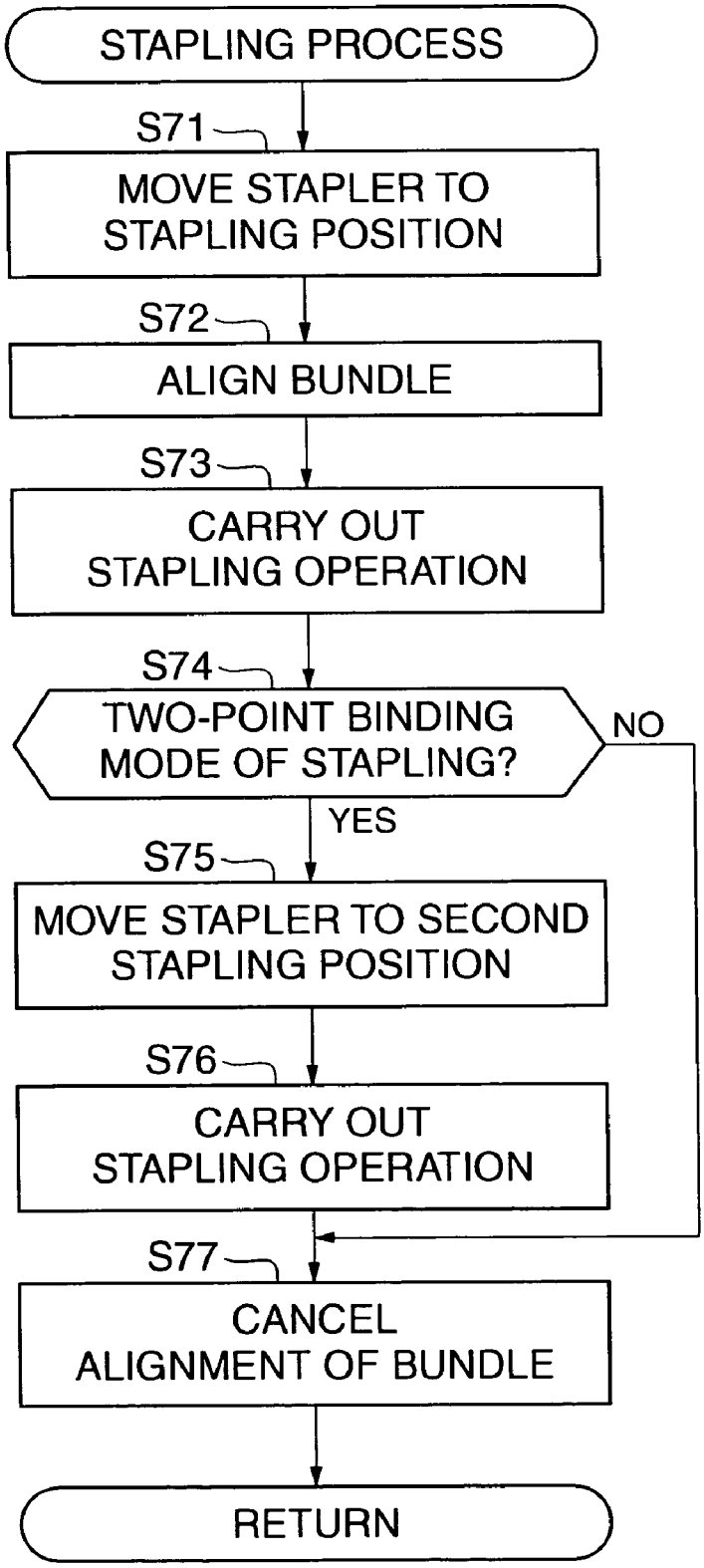
FIG. 32 is a flowchart showing a stapling process.

FIG. 32 is a flowchart of the stapling process executed in the step S64 in FIG. 31. First, the stapler 601 is moved by a predetermined amount to a stapling position (step S71), where the sheet bundle on the processing tray 630 is aligned by the outer-side aligning member 641 and the inner-side aligning member 642 (step S72), and then a stapling operation is carried out (step S73).

Thereafter, it is determined whether or not the two-point binding mode of the stapling operation has been designated (step S74). If the two-point binding mode has not been designated, the alignment of the sheet bundle by the outer-side aligning member 641 and the inner-side aligning member 642 is cancelled (step S77), followed by terminating the present process to return to the bundle discharge operation-determining process as the higher-order process.

On the other hand, if the two-point binding mode has been designated in the step S74, the stapler 601 is moved by a predetermined amount to a second stapling position (step S75), where a stapling operation for stapling the sheet bundle at a second point is carried out (step S76), and the alignment of the sheet bundle by the outer-side aligning member 641 and the inner-side aligning member 642 is cancelled (step S77), followed by terminating the present process to return to the bundle discharge operation-determining process as the higher-order process.

As described above, according to the sheet processing apparatus of the present embodiment, even when the interval between sheets discharged from the image forming apparatus main unit 10 is short, a plurality of sheets can be accurately superimposed by the buffer roller 505.

Figure 33:
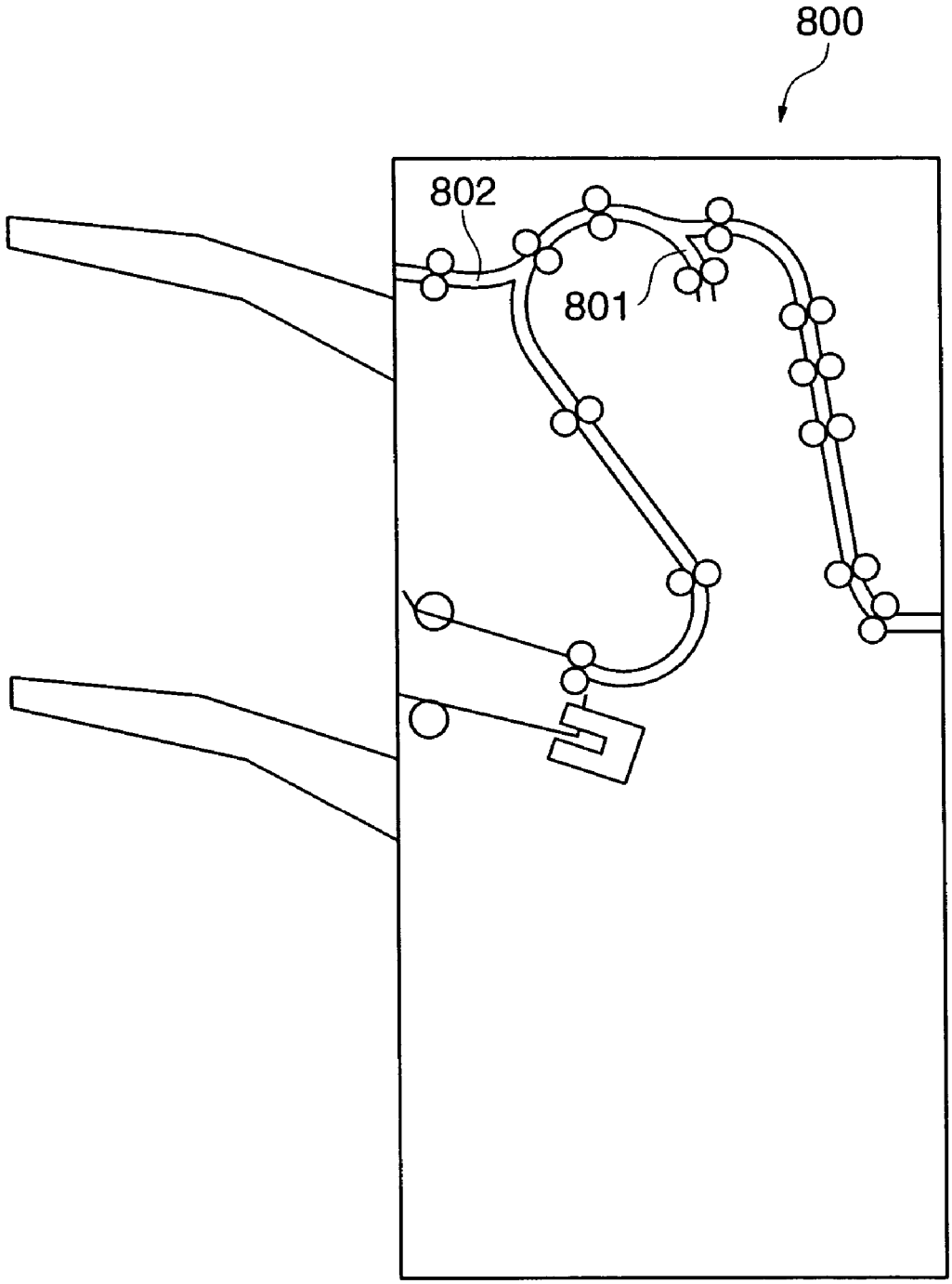
FIG. 33 is a longitudinal cross-sectional view showing another arrangement of the finisher.

Although in the present embodiment, the buffer mechanism of a type in which sheets are wound around a roller is employed, this is not limitative, but a buffer mechanism with another configuration may be employed. For example, as shown in FIG. 33, a buffer path 801 into and from which sheets are conveyed in a switch-back manner may be formed in a conveying path in a finisher 800 to superimpose sheets one upon another in the buffer path 801.

With this configuration, when two sheets are to be superimposed in the small sheet interval mode, a first sheet is conveyed to a path 802, and then the sheet is switched back and conveyed into the buffer path 801 to be kept on standby therein. In this case, when the trailing end of the first sheet leaves the image forming apparatus, the conveying speed is changed from V1 to V2 so as to convey the first sheet into the buffer path 801 with an increased space interval from a second sheet. Then, the second sheet is conveyed at the speed V1, and the first sheet is conveyed from the buffer path 801 such that the second sheet conveyed from the image forming apparatus can be superimposed on the first sheet, in a state offset therefrom by a predetermined distance or offset. Thereafter, the two sheets may be conveyed to the post-processing section.

When three sheets are to be superimposed, first and second sheets are conveyed at the speed V2, and a third one is conveyed at the speed V1.

It is further understood by those skilled in the art that the foregoing is a preferred embodiment of the invention, and that various changes and modification may be made without departing from the spirit and scope thereof.

What is claimed is:

1. A sheet processing apparatus that sequentially receives sheets discharged from an image forming apparatus and carries out post-processing on the sheets, comprising:

a sheet bundle stacking section that stacks sheets for one bundle, for carrying out the post-processing thereon;

a sheet retaining section provided at a location upstream of said sheet bundle stacking section, for retaining a plurality of sheets discharged from the image forming apparatus, such that each preceding sheet and at least one succeeding sheet are overlapping one another;

a first sheet conveying section that receives the sheets discharged from the image forming apparatus and conveys the sheets to said sheet retaining section;

a second sheet conveying section that conveys the sheets overlapped one another by said sheet retaining section to said sheet bundle stacking section; and a conveyance control section that controls said first sheet conveying section to change a conveying time period over which the sheets received from the image forming apparatus is conveyed to said sheet retaining section, wherein said conveyance control section is adapted to control said driver of said first sheet conveying section such that a conveying speed at which said first sheet conveying section conveys to said sheet retaining section a sheet preceding a final sheet of the sheets to be overlapped one another by said sheet retaining section is higher than a conveying speed at which said first sheet conveying section conveys the final sheet to said sheet retaining section, to increase a space interval between the sheet preceding the final sheet and the final sheet, wherein said conveyance control section has a first conveying mode in which the conveying speed at which all the sheets to be overlapped one another by said sheet retaining section are the same, and a second conveying mode in which the conveying speed at which the sheet preceding the final sheet is higher than the conveying speed at which the final sheet is conveyed, and wherein said conveyance control section switches between the first conveying mode and the second conveying mode, depending on time intervals at which the sheets are discharged from the image forming apparatus.

2. A sheet processing apparatus as claimed in claim 1, wherein said first sheet conveying section includes sheet driving members that engage each of the sheets discharged from the image forming apparatus and a driver that drives said sheet driving members to convey the engaged sheet.

3. A sheet processing apparatus as claimed in claim 2, wherein said conveyance control section controls said driver so that said sheet driving members convey the sheet preceding the final sheet in the second mode at a higher speed than the conveying speed of the sheets in the first conveying mode.

4. A sheet processing apparatus as claimed in claim 3, wherein the sheet driving members comprise at least one pair of rollers, and the driver comprises a motor for rotating the rollers.

* * * * *